US010808210B2

(12) United States Patent
Lee et al.

(10) Patent No.: US 10,808,210 B2
(45) Date of Patent: Oct. 20, 2020

(54) WATER-SOLUBLE FILM FOR DELAYED RELEASE

(71) Applicant: MONOSOL, LLC, Merrillville, IN (US)

(72) Inventors: David M. Lee, Crown Point, IN (US); Nicholas Zeese, Michigan City, IN (US); Jennifer L. Childers, Lowell, IN (US); Stephen Bullock, Chicago, IL (US)

(73) Assignee: MONOSOL, LLC, Merrillville, IN (US)

( * ) Notice: Subject to any disclaimer, the term of this patent is extended or adjusted under 35 U.S.C. 154(b) by 103 days.

(21) Appl. No.: 14/776,460

(22) PCT Filed: Mar. 13, 2014

(86) PCT No.: PCT/US2014/026305

§ 371 (c)(1),
(2) Date: Sep. 14, 2015

(87) PCT Pub. No.: WO2014/151718

PCT Pub. Date: Sep. 25, 2014

(65) Prior Publication Data

US 2016/0024446 A1 Jan. 28, 2016

Related U.S. Application Data

(60) Provisional application No. 61/801,807, filed on Mar. 15, 2013.

(51) Int. Cl.
*C11D 17/04* (2006.01)
*B65D 65/46* (2006.01)

(52) U.S. Cl.
CPC ..... *C11D 17/042* (2013.01); *C11D 17/045* (2013.01)

(58) Field of Classification Search
None
See application file for complete search history.

(56) References Cited

U.S. PATENT DOCUMENTS 2,220,099 A 11/1940 Guenther et al.
2,477,383 A 7/1949 Lewis
3,664,961 A 5/1972 Norris
3,919,678 A 11/1975 Penfold
4,000,093 A 12/1976 Nicol et al.
4,222,905 A 9/1980 Cockrell, Jr.
4,239,659 A 12/1980 Murphy
4,246,612 A 1/1981 Berry et al.
4,522,739 A * 6/1985 Gray ..... C11D 17/0039 252/186.39
4,725,378 A 2/1988 Krawczak
4,747,976 A * 5/1988 Yang ..... C11D 3/046 510/220
4,810,410 A 3/1989 Diakun et al.
4,885,105 A * 12/1989 Yang ..... C11D 3/02 206/524.3
5,114,611 A 5/1992 Van Kralingen et al.
5,137,646 A 8/1992 Schmidt et al.
5,151,273 A 9/1992 Korsatko-Wabnegg et al.
5,227,084 A 7/1993 Martens et al.
5,547,948 A 8/1996 Barcomb
5,576,281 A 11/1996 Bunch et al.
5,755,992 A 5/1998 Jeffrey et al.
5,965,505 A 10/1999 Baillely et al.
6,599,871 B2 7/2003 Smith
6,727,215 B2 4/2004 Roberts et al.
6,787,512 B1 * 9/2004 Verrall ..... C11D 17/043 428/35.2
8,288,332 B2 10/2012 Fossum et al.
8,728,449 B2 5/2014 Verrall et al.
2002/0013243 A1 * 1/2002 Hewitt ..... C11D 17/0004 510/293
2002/0169092 A1 * 11/2002 Alexandre Catlin ..... B65B 9/04 510/220
2003/0050209 A1 * 3/2003 Perkis ..... B65B 11/50 510/296
2003/0060390 A1 3/2003 Demeyere et al.
2003/0114333 A1 6/2003 Somerville-Roberts et al.
2003/0126282 A1 7/2003 Sarkar et al.
2003/0139312 A1 7/2003 Caswell et al.
2004/0029764 A1 2/2004 Weber et al.
2004/0033922 A1 * 2/2004 Gorlin ..... C11D 3/225 510/296
2004/0092635 A1 * 5/2004 Kitamura ..... C08J 5/18 524/386
2004/0161557 A1 * 8/2004 Verrall ..... B65D 65/46 428/35.2
2004/0161559 A1 * 8/2004 Verrall ..... B65D 65/46 428/35.7
2004/0204337 A1 10/2004 Corona et al.
(Continued)

FOREIGN PATENT DOCUMENTS

EP 0 197 434 A2 10/1986
EP 2258820 A1 12/2010
(Continued)

OTHER PUBLICATIONS

Throne, Technology of Thermoforming, Chapter 7, pp. 488-494, Hanser Gardner Pubns (1996).
(Continued)

*Primary Examiner* — Lorna M Douyon
(74) *Attorney, Agent, or Firm* — Marshall, Gerstein & Borun LLP

(57) ABSTRACT

The disclosure provides a water-soluble film, including polyvinyl alcohol (PVOH) and (PVOH) and an acrylate resin (e.g., methyl acrylate), wherein the water-soluble film remains intact for at least 3 minutes when submerged in water heated to a temperature of about 40° C., as determined by Bleach Compatibility Method A (described herein). The disclosure further provides a packet or pouch comprising water-soluble film of the disclosure. The packet or pouch can optionally include two or more compartments. The disclosure further provides a pouch including a first sealed compartment containing a first composition, the first sealed compartment comprising the water-soluble film according to the disclosure. Optionally, the first composition can include a bleach composition.

28 Claims, 3 Drawing Sheets

(56) References Cited

U.S. PATENT DOCUMENTS

| | | | | |
|---|---|---|---|---|
| 2006/0035042 | A1* | 2/2006 | Morken | C08F 216/06 428/35.2 |
| 2006/0079599 | A1 | 4/2006 | Arthur | |
| 2006/0257596 | A1 | 11/2006 | Catalfamo et al. | |
| 2007/0034575 | A1* | 2/2007 | Tufano | C02F 1/722 210/759 |
| 2007/0219111 | A1 | 9/2007 | Ward et al. | |
| 2007/0259996 | A1 | 11/2007 | Vicari et al. | |
| 2009/0011970 | A1 | 1/2009 | Evers | |
| 2009/0197789 | A1 | 8/2009 | Brooker et al. | |
| 2010/0125046 | A1 | 5/2010 | Denome et al. | |
| 2010/0192986 | A1 | 8/2010 | Brooker et al. | |
| 2011/0186467 | A1 | 8/2011 | Denome et al. | |
| 2011/0186468 | A1* | 8/2011 | Denome | B65D 65/46 206/524.7 |
| 2011/0188784 | A1 | 8/2011 | Denome et al. | |
| 2012/0164424 | A1* | 6/2012 | Vicari | C08F 218/08 428/220 |
| 2013/0118917 | A1* | 5/2013 | Hermann | C02F 1/46104 205/742 |
| 2013/0206638 | A1* | 8/2013 | Wong | C11D 3/046 206/524.7 |

FOREIGN PATENT DOCUMENTS

| | | | |
|---|---|---|---|
| FR | 2666348 | A1 | 3/1992 |
| FR | 2666349 | A1 | 3/1992 |
| GB | 1 137 741 | A | 12/1968 |
| GB | 1381121 | * | 1/1975 |
| JP | H06206833 | A | 7/1994 |
| JP | H08231436 | A | 9/1996 |
| JP | H11116437 | A | 4/1999 |
| JP | 2003-531953 | A | 10/2003 |
| JP | 2003-531954 | A | 10/2003 |
| JP | 2004-504443 | A | 2/2004 |
| JP | 2009-535484 | A | 10/2009 |
| JP | 2011-511123 | A | 4/2011 |
| JP | 2012-509388 | A | 4/2012 |
| JP | 2012-162081 | A | 8/2012 |
| JP | 2012-214505 | A | 11/2012 |
| JP | 2015-511978 | A | 4/2015 |
| WO | WO-2009/152031 | A1 | 12/2009 |
| WO | WO-2011/094690 | A1 | 8/2011 |
| WO | WO-2012/087821 | A1 | 6/2012 |

OTHER PUBLICATIONS

Schirmer et al. Prüfmethoden zur Bestimmung der Leistung von Klarspülern für das maschinelle Geschirrspülen, *Tenside, surfactants, detergents* 28.5: 313-319 (1991).

International Search Report and Written Opinion, International Application No. PCT/US2014/026305, dated Nov. 27, 2014.

International Preliminary Report on Patentability, International Application No. PCT/US2014/026305, dated Jul. 1, 2015.

Written Opinion of the International Preliminary Examining Authority, International Application No. PCT/US2014/026305, dated Mar. 30, 2015.

Patent Examination Report No. 1, Australian Patent Application No. 2014236931, dated Sep. 15, 2015.

Japanese Patent Application No. 2017-220111, Office Action, dated Dec. 25, 2018.

* cited by examiner

WATER-SOLUBLE FILM FOR DELAYED RELEASE

CROSS REFERENCE TO RELATED APPLICATION

The benefit under 35 U.S.C. § 119(e) of U.S. Provisional Patent Application Ser. No. 61/801,801 filed Mar. 15, 2013, is hereby claimed, and the disclosure thereof is hereby incorporated by reference herein.

FIELD OF THE DISCLOSURE

This disclosure relates generally to water-soluble films. More particularly, this disclosure relates to water-soluble film pouches or packets for the delayed release of an active agent from the water-soluble pouch or packet.

BACKGROUND

Water-soluble polymeric films are commonly used as packaging materials to simplify dispersing, pouring, dissolving and dosing of a material to be delivered. For example, packets made from water-soluble film are commonly used to package household care compositions, e.g., a pouch containing a laundry or dish detergent. A consumer can directly add the pouch to a mixing vessel, such as a bucket, sink or washing machine. Advantageously, this provides for accurate dosing while eliminating the need for the consumer to measure the composition. The pouch may also reduce mess that would be associated with dispensing a similar composition from a vessel, such as pouring a liquid laundry detergent from a bottle. The pouch also insulates the composition therein from contact with the user's hands. In sum, soluble polymeric film packets containing pre-measured agents provide for convenience of consumer use in a variety of applications.

The efficacy of certain laundry actives (e.g. enzymes) can be increased if alkaline actives (e.g. bleach additives) are introduced at a secondary stage that is delayed, for example by 15 to 20 minutes. To achieve the delayed release of alkaline actives in a wash cycle, a water-soluble film packet must be slow dissolving and remain substantially intact for the 15-20 minutes at nominally 40° C. The components of the unit dose packet system must also be made to be chemically compatible with each other or chemically isolated from one another as to prevent any chemical or physical changes to the packaged materials.

Some water-soluble polymeric films that are used to make packets will incompletely dissolve during such a laundry wash cycle, leaving film residue on items within the wash, or will dissolve prematurely resulting in a decreased efficacy of certain laundry additives (e.g., enzymes) that may become unstable in the presence of other active agents.

Water-soluble polymeric films based on PVOH can be subject to changes in solubility characteristics. The acetate group in the co-poly(vinyl acetate vinyl alcohol) polymer is known by those skilled in the art to be hydrolysable by either acid or alkaline hydrolysis. This is an inherent weakness in the application of films based on just the vinyl acetate/alcohol co-polymer typified by commercial PVOH resins. In the presence of a strong base such as a laundry bleaching additive PVOH resins with pendant carboxyl groups such as vinyl alcohol/hydrolyzed methyl acrylate sodium salt resins will deteriorate over the course of several weeks at relatively warm (ambient) and high humidity conditions.

Thus, it is believed that such a film can become more soluble due to chemical interactions between the film and an alkaline composition inside the pouch during storage. Consequently, as they age, the packets may become increasingly prone to premature dissolution during a hot wash cycle (nominally 40° C.), and may in turn decrease the efficacy of certain laundry actives due to the presence of the bleaching agent.

The current state of the art in water-soluble/reactive/dispersible pouches and packets for delivering bleach with a delay relative to a laundry detergent includes the use of a multi-compartment water-soluble pouch made from polyvinyl alcohol (PVOH) film, wherein the second pouch, containing a solid, dissolves slower than the first as is described in U.S. Pat. No. 6,727,215, and U.S. Patent Publication Nos. 2009/0011970 and 2010/0192086. Further, various different chemical coatings applied to powders of bleach or bleach activator as a means to delay release are described in U.S. Pat. Nos. 4,725,378; 5,965,505; and 5,755,992.

There remains a need for packets comprising water-soluble films having the desired characteristics of delayed release in hot water, sufficient solubility as to not leave any film residue on the wash load once the wash cycle is complete, chemical and physical compatibility with laundry detergent, and mechanical properties including good processability.

SUMMARY

The present disclosure provides a water-soluble pouch or packet including a first sealed compartment containing a first composition, the first sealed compartment including a water-soluble film, the water-soluble film including a polyvinyl alcohol (PVOH) and an acrylate resin (e.g., methyl acrylate) and the first composition including an alkaline agent. Optionally, the water-soluble film remains intact for at least 3 minutes when submerged in water heated to a temperature of about 40° C., as determined by Bleach Compatibility Method A (described herein), and thereafter fully dissolves. Optionally, the alkaline agent can include a bleach composition. Further optionally, the bleach composition can be coated with a coating. The packet or pouch can optionally include two or more compartments.

In a related aspect, the disclosure provides a method of making a film for delayed solubility in hot water according to the steps of selecting a water-soluble resin comprising PVOH and methyl acrylate; wherein the water-soluble resin comprises about 5 mol % methyl acrylate and preparing a water-soluble film having a thickness of about 3 mil to about 6 mil (about 0.076 mm to about 0.15 mm).

In one embodiment, the packet includes a first and a second sealed compartment. The second compartment is in a generally superposed relationship with the first sealed compartment such that the second sealed compartment and the first sealed compartment share a partitioning wall interior to the pouch.

In one embodiment, the packet including a first and a second compartment further includes a third sealed compartment. The third sealed compartment is in a generally superposed relationship with the first sealed compartment such that the third sealed compartment and the first sealed compartment share a partitioning wall interior to the pouch.

In some embodiments, the first composition and the second composition are individually selected from liquids, and powders. For example, the embodiments can include the following combinations: liquid, liquid; liquid, powder; powder, powder; and powder, liquid.

In some embodiments, the first, second and third compositions individually are individually selected from liquids, and powders. For example, the embodiments can include the following combinations: solid, liquid, liquid; solid, solid, liquid; and liquid, liquid, liquid.

In any of the embodiments, the single compartment or plurality of sealed compartments contains a composition. The plurality of compartments may each contain the same or a different composition. The composition is selected from a liquid, solid or combination thereof. As used herein, "liquid" includes pastes, liquids, gels, foams or mousse. Non-limiting examples of liquids include light duty and heavy duty liquid detergent compositions, fabric enhancers, detergent gels commonly used for laundry, bleach and laundry additives. Gases, e.g., suspended bubbles or solids e.g. particles, may be included within the liquids. A "solid" as used herein includes powders, agglomerates or mixtures thereof. Non-limiting examples of solids include: micro-capsules; beads; noodles; and pearlised balls. Solids, e.g., solid composition(s), may provide a technical benefit including, but not limited to, through-the-wash benefits, pre-treatment benefits, and/or aesthetic effects.

In any of the embodiments, the composition may be selected from the group of liquid light duty and liquid heavy duty liquid detergent compositions, powdered detergent compositions, fabric enhancers, detergent gels commonly used for laundry, and bleach and laundry additives.

Further aspects and advantages will be apparent to those of ordinary skill in the art from a review of the following detailed description, taken in conjunction with the drawings. While the compositions, films, pouches, and packets described herein are susceptible to embodiments in various forms, the description hereafter includes specific embodiments with the understanding that the disclosure is illustrative, and is not intended to limit the invention to the specific embodiments described herein.

Optional features, such as specific components, compositional ranges thereof, substituents, conditions, and method steps, can be selected from the various examples provided herein.

BRIEF DESCRIPTION OF THE DRAWINGS

For further facilitating the understanding of the present disclosure, four drawing figures are appended hereto, wherein.

DETAILED DESCRIPTION

Figure 3:
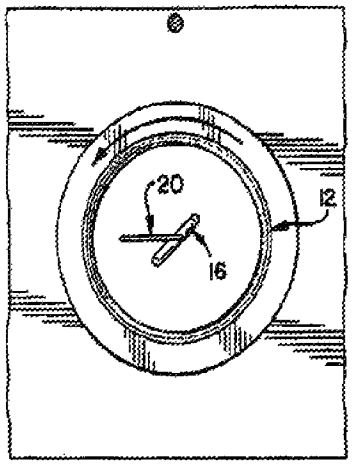
FIG. 3 is a top view of the test set-up of FIG. 2.

The present disclosure provides a water-soluble pouch or packet including a first sealed compartment containing a first composition, the first sealed compartment including a wall of a water-soluble film, the water-soluble film including a polyvinyl alcohol (PVOH) and acrylate resin and the first composition including an alkaline agent. Preferably, the film is a monolayer film. The compartment can have its entire wall structure provided by the PVOH-based film. In any type of embodiment described herein, the acrylate resin can be a methyl acrylate. As an alternative, in any type of embodiment described herein, the acrylate resin can be a methyl acrylate or a methyl methacrylate. Optionally, the water-soluble film remains intact for at least 3 minutes when submerged in water heated to a temperature of about 40° C., as determined by Bleach Compatibility Method A (described herein), and thereafter fully dissolves. Optionally, the alkaline agent can include a bleach composition. Further optionally, the bleach composition can be coated with a coating. The packet or pouch can optionally include two or more compartments. In addition or in the alternative, the water-soluble film including polyvinyl alcohol (PVOH) and methyl acrylate resin remains intact for at least 9 minutes in a washing machine at 40° C., as determined by Bleach Compatibility Method B (described herein), and thereafter fully dissolves. Advantageously, the water soluble film of the disclosure can be used to delay the release of an alkaline bleaching agent into a wash cycle, thereby delaying basification of the wash water and reducing loss of functionality from alkaline sensitive materials present in laundry detergents.

The articles and methods are contemplated to include embodiments including any combination of one or more of the additional optional elements, features, and steps further described below (including those shown in the figures), unless stated otherwise.

As used herein, the term "comprising" indicates the potential inclusion of other agents, elements, steps, or features, in addition to those specified.

Advantageously, when a bleach component is coated as described herein and enclosed within a pouch comprising the water-soluble film of the present disclosure, the water-soluble film remains intact for at least 8 minutes when submerged in water heated to a temperature of about 40° C., as determined by Bleach Compatibility Method A, corresponding to at least 15 minutes in a washing machine, as determined by Bleach Compatibility Method B. Thus, the water-soluble film/bleach coating of the disclosure can be used to delay the release of an alkaline bleaching agent into a wash cycle for at least 15 minutes, thereby delaying basification of the water and preventing loss of functionality from alkaline sensitive materials (such as enzymes) present in laundry detergents.

In a related aspect, the disclosure provides a method of making a film for delayed solubility in hot water according to the steps of selecting a water-soluble resin comprising PVOH and methyl acrylate; wherein the water-soluble resin comprises about 5 mol % methyl acrylate and preparing a water-soluble film having a thickness of about 3 mil to about 6 mil (about 0.076 mm to about 0.15 mm).

In one embodiment, the packet includes first and second sealed compartments. The second compartment can be in a generally superposed relationship with the first sealed compartment such that the second sealed compartment and the first sealed compartment share a partitioning wall interior to the pouch.

In one embodiment, the packet including a first and a second compartment further includes a third sealed compartment. The third sealed compartment can be in a generally superposed relationship with the first sealed compartment such that the third sealed compartment and the first sealed compartment share a partitioning wall interior to the pouch.

In some embodiments, the first composition and the second composition are individually selected from liquids, and powders. For example, the embodiments can include the following combinations: liquid, liquid; liquid, powder; powder, powder; and powder, liquid.

In some embodiments, the first, second and third compositions individually are individually selected from liquids and solids. For example, the embodiments can include the following combinations: solid, liquid, liquid; solid, solid, liquid; and liquid, liquid, liquid.

In any of the embodiments, the single compartment or plurality of sealed compartments contains a composition. The plurality of compartments may each contain the same or a different composition. The composition can be selected from a liquid, solid or combination thereof. As used herein, "liquid" includes free-flowing liquids, as well as pastes, gels, foams and mousses. Non-limiting examples of liquids include light duty and heavy duty liquid detergent compositions, fabric enhancers, detergent gels commonly used for laundry, bleach and laundry additives. Gases, e.g., suspended bubbles, or solids, e.g. particles, may be included within the liquids. A "solid" as used herein includes, but is not limited to, powders, agglomerates, and mixtures thereof. Non-limiting examples of solids include: micro-capsules; beads; noodles; and pearlised balls. Solid compositions, may provide a technical benefit including, but not limited to, through-the-wash benefits, pre-treatment benefits, and/or aesthetic effects.

In any of the laundry-centric embodiments, the composition may be selected from the group of liquid light duty and liquid heavy duty liquid detergent compositions, powdered detergent compositions, fabric enhancers, detergent gels commonly used for laundry, and bleach and laundry additives, for example.

As used herein, the term "comprising" indicates the potential inclusion of other agents, elements, steps, or features, in addition to those specified.

As used herein and unless specified otherwise all measurements of PVOH viscosity in centipoise (cP) are of a 4% (w/v) solution in water at 20° C., and unless specified otherwise all measurements of carboxymethyl cellulose viscosity are of a 2% (w/v) solution in water at 25° C.

As used herein and unless specified otherwise, the terms "wt. %" and "wt %" are intended to refer to the composition of the identified element in "dry" (non water) parts by weight of the entire film (when applicable) or parts by weight of the entire composition enclosed within a pouch (when applicable). As used herein and unless specified otherwise, the term "phr" is intended to refer to the composition of the identified element in parts per one hundred parts water-soluble PVOH resins.

As used herein and unless specified otherwise, the term "disintegration" refers to the point at a water soluble pouch releases the entire contents of the pouch without dissolution of the film.

As used herein and unless specified otherwise, the term "dissolution" refers to the point at which a film and any of its fragmented remains are completely dissolved and are in solution.

As used herein and unless specified otherwise, the term "inadequate solubility" refers to a film that does not completely dissolve in water heated to a temperature of 40° C. in 55 minutes or less.

As used herein and unless specified otherwise, the term "Point A Time" refers to the point at which the pH of the solution begins to climb at a rate greater than or equal to 0.1 pH units per minute in Bleach Compatibility Method A.

The water-soluble film according to the disclosure includes polyvinyl alcohol (PVOH). PVOH is a synthetic resin generally prepared by the alcoholysis, usually termed hydrolysis or saponification, of polyvinyl acetate. Fully hydrolyzed PVOH, wherein virtually all the acetate groups have been converted to alcohol groups, is a strongly hydrogen-bonded, highly crystalline polymer which dissolves only in hot water—greater than about 140° F. (60° C.). If a sufficient number of acetate groups are allowed to remain after the hydrolysis of polyvinyl acetate, the PVOH polymer then being known as partially hydrolyzed, it is more weakly hydrogen-bonded and less crystalline and is soluble in cold water—less than about 50° F. (10° C.). An intermediate cold/hot water soluble film can include, for example, intermediate partially-hydrolyzed PVOH (e.g., with degrees of hydrolysis of about 94% to about 98%), and is readily soluble only in warm water—e.g., rapid dissolution at temperatures of about 40° C. and greater. Both fully and partially hydrolyzed PVOH types are commonly referred to as PVOH homopolymers although the partially hydrolyzed type is technically a vinyl alcohol-vinyl acetate copolymer. Accordingly, a copolymer with an acrylate can be a vinyl alcohol-vinyl acetate terpolymer.

It is well known in the art that the viscosity of a resin is correlated with the weight average molecular weight ($\overline{M}w$) of the same resin, and often the viscosity is used as a proxy for $\overline{M}w$. The viscosity of a PVOH resin is determined by measuring a freshly made solution using a Brookfield LV type viscometer with UL adapter as described in British Standard EN ISO 15023-2:2006 Annex E Brookfield Test method.

As mentioned above, the acetate group in the co-poly (vinyl acetate vinyl alcohol) polymer is hydrolyzable by either acid or alkaline hydrolysis. As a result, the solubility characteristics of packets formed with PVOH can, under appropriate circumstances, degrade over time and thus the packets may prematurely dissolve.

It has been found, as demonstrated in the examples, that the solubility of films comprising fully hydrolyzed PVOH (i.e. a degree of hydrolysis of 98-100%) homopolymers in 40° C. water is dependent on the molecular weight of the PVOH. For example, films comprising low molecular weight, fully hydrolyzed PVOH homopolymers, wherein the viscosity is about 4 cPs or less, are fully soluble at 40° C. Films comprising fully hydrolyzed PVOH homopolymers characterized by a viscosity greater than 10 cPs are not soluble at 40° C. and films comprising fully hydrolyzed PVOH homopolymers characterized by viscosities of about 5-6 cPs demonstrate inconsistent solubility at 40° C. It was further found that the fully hydrolyzed PVOH homopolymers that were soluble at 40° C. (i.e., characterized by lower viscosities and thus having lower molecular weights) were difficult to process and the resulting films had poor mechanical properties.

It has been further found, as demonstrated in the examples, that the solubility of films comprising partially hydrolyzed PVOH homopolymers in 40° C. water is dependent upon the pH of the water. At neutral pH, films comprising partially hydrolyzed PVOH homopolymers were fully soluble in water at 40° C. However, when tested in contact with an alkaline agent (e.g., with sodium carbonate and percarbonate) the films became insoluble in water at 40° C. Without intending to be bound by theory, it is believed that the sodium carbonate further hydrolyzes the resin, resulting in a fully hydrolyzed homopolymer, which has been shown to be insoluble in water at 40° C. This interaction makes partially hydrolyzed PVOH homopolymers unsuitable for use by themselves in films for package alkaline components, including bleach components such as sodium carbonate or percarbonate, for dissolution release into a wash water system at 40° C.

The PVOH resins of the disclosure demonstrate good processability characteristics, and films comprising the PVOH resin of the disclosure are soluble at 40° C., even while in contact with a 1:1 mixture of sodium carbonate and percarbonate. The PVOH resin of the disclosure is a copolymer including PVOH and an acrylate.

The PVOH included in the copolymer used in the water-soluble films of the present disclosure can be fully hydrolyzed (i.e., the degree of hydrolysis is about 98% to about 100%), having very little residual acetate groups. As the degree of hydrolysis is reduced below fully hydrolyzed, a film made from the resin will have reduced mechanical strength but faster solubility. Of course, as known in the art, below a degree of hydrolysis of about 60% the PVOH resins and films made therefrom will no long be water soluble The copolymer of the invention can comprise about 5 mol % of an acrylate, for example methyl acrylate and/or methyl methacrylate. Without intending to be bound by theory it is believed that the pendant carboxyl groups from the acrylate undergo methanolysis to form lactone rings. It is believed that because the closed lactone rings do not undergo hydrolysis to form fully hydrolyzed PVOH, the resin remains soluble at 40° C., even in the presence of sodium carbonate. As shown in the examples, as the mol % of acrylate, for example methyl methylacrylate, in the copolymer decreases below 5%, the solubility of the PVOH copolymer resin in water heated to a temperature of about 40° C. decreases. It is believed that the decrease in solubility is due to the resin more closely resembling a fully hydrolyzed PVOH polymer because of the increased amount of PVOH in the copolymer. Further, it is believed that as the mol % of acrylate in the copolymer increases above 5 mol %, the solubility of the PVOH copolymer resin in water heated to a temperature of about 40° C. decreases as the polymer becomes only soluble in increasingly hot water.

The amount of acrylate resin in an acrylate-PVOH copolymer can be used to effect the solubility, and therefore the delayed release characteristics, of a water-soluble film comprising the acrylate-PVOH copolymer and packets made from the water-soluble film. For example, a packet comprising a water-soluble film including greater than about 5 mol % acrylate in the water-soluble resin would demonstrate a similar length of delayed release of the contents enclosed in the packet as a at a lower temperature than a packet comprising a water-soluble film including about 5 mol % acrylate in the water-soluble resin. Further, a packet comprising a water-soluble film including less than about 5 mol % acrylate in the water-soluble resin would demonstrate a similar length of delayed release of the contents enclosed in the packet at a higher temperature than a packet comprising a water-soluble film including about 5 mol % acrylate in the water-soluble resin. The amount of acrylate included in the water-soluble PVOH copolymer can be between about 2 mol % and about 10 mol %, about 2 mol % and about 8 mol %, about 2 mol % and about 6 mol %, about 3 mol % to about 6 mol %, about 4 mol % and about 6 mol %, and/or about 5 mol %.

The water-soluble resin can be included in the water-soluble film in any suitable amount, for example an amount in a range of about 35 wt % to about 90 wt %, or about 40 wt % to about 90 wt %, or about 45 wt % to about 90 wt %, or about 50 wt % to about 90 wt %, or about 55 wt % to about 90 wt %, or about 60 wt % to about 90 wt %, or about 65 wt % to about 90 wt %, or about 70 wt % to about 90 wt %, or about 75 wt % to about 85 wt %, or about 80 wt %.

Water-soluble PVOH resins for use in the films described herein can be characterized by any suitable viscosity for the desired film properties, optionally a viscosity in a range of about 8.0 to about 40.0 cP, or about 10.0 cP to about 30 cP, or about 13 cP to about 27 cP.

The water-soluble films according to the present disclosure may include other optional additive ingredients including, but not limited to, plasticizers, surfactants, emulsifiers, fillers, extenders, antiblocking agents, detackifying agents, antifoams, film formers and other functional ingredients, for example in amounts suitable for their intended purpose.

Water is recognized as a very efficient plasticizer for PVOH and other polymers; however, the volatility of water makes its utility limited since polymer films need to have at least some resistance (robustness) to a variety of ambient conditions including low and high relative humidity. Glycerin is much less volatile than water and has been well established as an effective plasticizer for PVOH and other polymers. Glycerin or other such liquid plasticizers by themselves can cause surface "sweating" and greasiness if the level used in the film formulation is too high. This can lead to problems in a film such as unacceptable feel to the hand of the consumer and even blocking of the film on the roll or in stacks of sheets if the sweating is not mitigated in some manner, such as powdering of the surface. This could be characterized as over plasticization. However, if too little plasticizer is added to the film the film may lack sufficient ductility and flexibility for many end uses, for example to be converted into a final use format such as packets.

Plasticizers for use in water-soluble films of the present disclosure include, but are not limited to, sorbitol, glycerol, diglycerol, propylene glycol, ethylene glycol, diethyleneglycol, triethylene glycol, tetraethyleneglycol, polyethylene glycols up to MW 400, 2 methyl 1,3 propane diol, lactic acid, monoacetin, triacetin, triethyl citrate, 1,3-butanediol, trimethylolpropane (TMP), polyether triol, and combinations thereof. As less plasticizer is used, the film can become more brittle, whereas as more plasticizer is used the film can lose tensile strength. Plasticizers can be included in the water-soluble films in an amount in a range of about 10 phr to about 50 phr, or from about 10 phr to about 40 phr, or from about 15 phr to about 30 phr, for example.

Surfactants for use in water-soluble films are well known in the art. Optionally, surfactants are included to aid in the dispersion of the resin solution upon casting. Suitable surfactants for water-soluble films of the present disclosure include, but are not limited to, dialkyl sulfosuccinates, lactylated fatty acid esters of glycerol and propylene glycol, lactylic esters of fatty acids, sodium alkyl sulfates, polysorbate 20, polysorbate 60, polysorbate 65, polysorbate 80, alkyl polyethylene glycol ethers, lecithin, acetylated fatty acid esters of glycerol and propylene glycol, sodium lauryl sulfate, acetylated esters of fatty acids, myristyl dimethylamine oxide, trimethyl tallow alkyl ammonium chloride, quaternary ammonium compounds, salts thereof and combinations of any of the forgoing. Too little surfactant can sometimes result in a film having holes, whereas too much surfactant can result in the film having a greasy or oily feel from excess surfactant present on the surface of the film. Thus, surfactants can be included in the water-soluble films in an amount of less than about 2 phr, for example less than about 1 phr, or less than about 0.5 phr, for example.

One type of secondary component contemplated for use in the film-forming composition is a defoamer. Defoamers can aid in coalescing of foam bubbles. Suitable defoamers for use in water-soluble films according to the present disclosure include, but are not limited to, hydrophobic silicas, for example silicon dioxide or fumed silica in fine particle sizes, including Foam Blast® defoamers available from Emerald Performance Materials, including Foam Blast® 327, Foam Blast® UVD, Foam Blast® 163, Foam Blast® 269, Foam Blast® 338, Foam Blast® 290, Foam Blast® 332, Foam Blast® 349, Foam Blast® 550 and Foam Blast® 339, which are proprietary, non-mineral oil defoamers. In embodiments, defoamers can be used in an amount of 0.7 phr, or less, for example, 0.5 phr, 0.05 phr, 0.04 phr, 0.03 phr, 0.02 phr, or 0.01 phr.

Suitable lubricants/release agents can include, but are not limited to, fatty acids and their salts, fatty alcohols, fatty esters, fatty amines, fatty amine acetates and fatty amides. Preferred lubricants/release agents are fatty acids, fatty acid salts, and fatty amine acetates. In embodiments, lubricant/release agents can be used in an amount of about 0.02 wt % to about 1.5 wt %, optionally about 0.1 wt % to about 1 wt %, for example.

Suitable fillers/extenders/antiblocking agents/detackifying agents include, but are not limited to, starches, modified starches, crosslinked polyvinylpyrrolidone, crosslinked cellulose, microcrystalline cellulose, silica, metallic oxides, calcium carbonate, talc and mica. Preferred materials are starches, modified starches and silica. In one type of embodiment, the amount of filler/extender/antiblocking agent/detackifying agent in the water-soluble film is in a range of about 1 wt % to about 6 wt %, or about 1 wt. % to about 4 wt. %, or about 2 wt. % to about 4 wt. %, for example.

During preparation of PVOH resin solutions a browning effect can occur. Whereas, in most applications, clear and colorless water-soluble films are desirable, a suitable bleaching agent can be added to the PVOH resin solution. The use of sodium metabisulfite has been found to substantially maintain the solution clarity and colorlessness during preparation when used in the composition in an amount in the range of about 0.05 wt. % to about 1.0 wt. %, or about 0.05 wt. % to about 0.7 wt. %, or about 0.1 wt. % to about 0.5 wt. %, or about 0.1 wt. % to about 0.3 wt. %, or about 0.2 wt. %.

The thickness of the water-soluble film can also be used to effect the solubility and delayed-release characteristics of the water-soluble films and packets made from the water-soluble films. As the thickness of the water-soluble film increases, the dissolution time of the water-soluble film increases. Water-soluble films of the disclosure can have a thickness of about 3 mil to about 6 mil (about 0.076 mm to about 0.15 mm), for example, about 3.5 mil to about 6 mil (about 0.09 mm to about 0.15 mm), or about 0.4 mil to about 5.5 mil (about 0.10 mm to about 0.14 mm), or about 4.5 mil to about 5.5 mil (0.11 mm to about 0.14 mm), or about 5 mil (0.13).

The water-soluble films of the disclosure are advantageous in that they can remain intact for at least about 3 minutes, as determined by Bleach Compatibility Method A, or at least 9 minutes as determined by Bleach Compatibility Method B, after submersion in water heated to a temperature of 40° C., when in contact with a 1:1 mixture of sodium carbonate and percarbonate.

Bleach Compatibility Method A is a laboratory test that can be used to determine if a water-soluble film is chemically compatible with an alkaline agent, such as a bleach. The test sample for Method A is a small, 2×2 inches (5.08×5.08 cm), nominal 5 mil (127 μm), water-soluble film pouch filled with either 5.8 g of 1:1 (wt %) sodium carbonate and sodium percarbonate mixed powder or a 10 g compressed tablet of the same material, and then heat sealed. The bleach tablets can comprise stearic acid as a binding agent and are made with compression techniques well known to those skilled in the art. The bleach powder materials are available from Solvay Chemicals. The pouch is secured using a vinyl coated 0.5 inch (1.3 cm) metal mesh cage and is submerged into a 600 ml beaker containing 500 ml of 40° C. deionized water, and stirred. The water is stabilized to pH 7 before submerging the metal mesh cage containing the pouch. After the pouch is submerged, the pH of the water is monitored using a pH probe and recorded every minute until a pH of 9.5 or higher is reached, or until 20 minutes has elapsed. The integrity and dissolution behavior of the pouch is observed and recorded.

Ideal dissolution behavior of a water-soluble film in contact with an alkaline bleach in 40° C. water is marked by a sudden increase in pH through the release of the active materials from the pouch in a range of about 9 to about 12 minutes from the start of the test. This ideal behavior corresponds to an active release delay of about 15-20 minutes within a commercially-available laundry machine cycle at nominally 40° C. wash water (Bleach Compatibility Method B).

Bleach Compatibility Method B tests the dissolution behavior of water-soluble packets prepared from water-soluble film that enclose a bleaching agent in a commercially-available laundry machine. The test samples are prepared as described above for Method A. The samples are tested in a SIEMENS brand S16-79 washing machine using the program Koch/Bunt (cotton/colored), or an equivalent. The SIEMENS brand S16-79 automatic washing machine has a 65 liter drum capacity and variable temperature selection. The temperature of the wash water was either 20° C., 40° C., or 60° C. In the tests reported herein, the water hardness was determined to be 250 ppm $CaCO_3$ (14° d, German hardness degrees). The wash load is 3 kg, consisting of 2 bed sheets (1.5×1.5 m ISO 2267), 4 pillow cases (0.8×0.8 m ISO 2267), and 3 huckaback towels cotton bleached. The dissolution time for Method B corresponds to the time at which a pH of 9.5 or higher is reached, as measured by a pH probe. In one type of embodiment, the desired behavior is marked by a sudden increase in pH through the release of the active materials from the pouch at about 15 to 20 minutes within a commercially-available automatic laundry machine cycle using nominally 40° C. wash water.

A contemplated class of embodiments is characterized by good thermoformability of the water-soluble film made as described herein. A thermoformable film is one that can be shaped through the application of heat and a force.

Thermoforming a film is the process of heating the film, shaping it, for example in a mold, and then allowing the film to cool, whereupon the film will hold the formed shape, e.g. the shape of the mold. The heat may be applied using any suitable means. For example, the film may be heated directly by passing it under a heating element or through hot air, prior to feeding it onto a surface or once on a surface. Alternatively, it may be heated indirectly, for example by heating the surface or applying a hot item onto the film. In some embodiments, the film is heated using an infrared light. The film may be heated to a temperature in a range of about 50° C. to about 150° C., about 50° C. to about 120° C., about 60° C. to about 130° C., about 70° C. to about 120° C., or about 60° C. to about 90° C. Thermoforming can be performed by any one or more of the following processes, for example: the manual draping of a thermally softened film over a mold, or the pressure induced shaping of a softened film to a mold (e.g., vacuum forming), or the automatic high-speed indexing of a freshly extruded sheet having an accurately known temperature into a forming and trimming station, or the automatic placement, plug and/or pneumatic stretching and pressuring forming of a film. The extent of the film stretch is defined by the areal draw ratio which is the pocket (or cavity) surface area divided by the film surface area before thermoforming. The areal draw ratio (also called areal depth of draw) can be calculated according to the method described in *Technology of Thermoforming*, James L. Throne, Hanser publisher, (1996) Chapter 7.4, pg 488-494 (ISBN 3-446-17812-0). Herein for thermoformed films, the areal draw ratio can be in a range of 1.05 to 2.7; or in a range of 1.2 to 2.3; or in a range of 1.3 to 2.0.

In the alternative to or in addition to heating, the film can be wetted by any suitable means, for example directly by spraying a wetting agent (including water, a solution of the film composition, a plasticizer for the film composition, or any combination of the foregoing) onto the film, prior to feeding it onto the surface or once on the surface, or indirectly by wetting the surface or by applying a wet item onto the film.

Once a film has been heated and/or wetted, it may be drawn into an appropriate mold, preferably using a vacuum. The filling of the molded film can be accomplished by utilizing any suitable means. In some embodiments, the most preferred method will depend on the product form and required speed of filling. In some embodiments, the molded film is filled by in-line filling techniques. The filled, open packets are then closed forming the pouches, using a second film, by any suitable method. This may be accomplished while in horizontal position and in continuous, constant motion. The closing may be accomplished by continuously feeding a second film, preferably water-soluble film, over and onto the open packets and then preferably sealing the first and second film together, typically in the area between the molds and thus between the packets. Such package forming and sealing methods are already known in the art.

Any suitable method of sealing the packet and/or the individual compartments thereof may be utilized. Non-limiting examples of such means include heat sealing, solvent welding, solvent or wet sealing, and combinations thereof. Typically, only the area which is to form the seal is treated with heat or solvent. The heat or solvent can be applied by any method, typically on the closing material, and typically only on the areas which are to form the seal. If solvent or wet sealing or welding is used, it may be preferred that heat is also applied. Preferred wet or solvent sealing/welding methods include selectively applying solvent onto the area between the molds, or on the closing material, by for example, spraying or printing this onto these areas, and then applying pressure onto these areas, to form the seal. Sealing rolls and belts as described above (optionally also providing heat) can be used, for example.

The formed pouches may then be cut by a cutting device. Cutting can be accomplished using any known method. It may be preferred that the cutting is also done in continuous manner, and preferably with constant speed and preferably while in horizontal position. The cutting device can, for example, be a sharp item, or a hot item, or a laser, whereby in the latter cases, the hot item or laser 'burns' through the film/sealing area.

The different compartments of a multi-compartment pouches may be made together in a side-by-side style wherein the resulting, cojoined pouches may or may not be separated by cutting. Alternatively, the compartments can be made separately.

In embodiments, pouches may be made according to a process comprising the steps of:

a) forming a first compartment (e.g., as described above);
b) forming a recess within some or all of the closed compartment formed in step (a), to generate a second molded compartment superposed above the first compartment;
c) filling and closing the second compartments by means of a third film;
d) sealing the first, second and third films; and
e) cutting the films to produce a multi-compartment pouch.

The recess formed in step (b) may be achieved by applying a vacuum to the compartment prepared in step (a).

In some embodiments, second, and/or third compartment(s) can be made in a separate step and then combined with the first compartment as described in European Patent Application Number 08101442.5 or WO 2009/152031 (filed Jun. 13, 2008 and assigned to the Procter & Gamble Company).

In some embodiments, pouches may be made according to a process comprising the steps of:

a) forming a first compartment, optionally using heat and/or vacuum, using a first film on a first forming machine;
b) filling the first compartment with a first composition;
c) on a second forming machine, deforming a second film, optionally using heat and vacuum, to make a second and optionally third molded compartment;
d) filling the second and optionally third compartments;
e) sealing the second and optionally third compartment using a third film;
f) placing the sealed second and optionally third compartments onto the first compartment;
g) sealing the first, second and optionally third compartments; and
h) cutting the films to produce a multi-compartment pouch.

The first and second forming machines may be selected based on their suitability to perform the above process. In some embodiments, the first forming machine is a horizontal forming machine, and the second forming machine is a rotary drum forming machine, for example located above the first forming machine.

It should be understood that by the use of appropriate feed stations, it may be possible to manufacture multi-compartment pouches incorporating a number of different or distinctive compositions and/or different or distinctive liquid, gel or paste compositions.

The present pouches may contain various compositions. A multi-compartment pouch may contain the same or different compositions in each separate compartment.

As described above, the film and pouch of the disclosure are particularly advantageous for packaging (e.g., in direct contact with) alkaline materials.

This feature of the disclosure may be utilized to keep compositions containing incompatible ingredients (e.g., bleach and enzymes) physically separated or partitioned from each other. It is believed that such partitioning may expand the useful life and/or decrease physical instability of such ingredients. Additionally or alternatively, such partitioning may provide aesthetic benefits as described in European Patent Application Number 09161692.0 (filed Jun. 2, 2009 and assigned to the Procter & Gamble Company).

Pouches made of films according to the disclosure advantageously delay the release of alkaline agents, such as sodium carbonate or percarbonate bleaching agents, for at least 3 minutes, as determined by Bleach Compatibility Method A, or at least 9 minutes as determined by Bleach Compatibility Method B, after submersion in water heated to a temperature of 40° C., when in contact with a 1:1 mixture of sodium carbonate and percarbonate, followed by full dissolution of the film.

Pouches may comprise one or more alkaline agents, including an inorganic bleach. Without intending to be bound by theory, it is believed that the inorganic bleaching agents, including sodium carbonate and/or percarbonate in the presence of water or high humidity will deteriorate PVOH film, thereby increasing the solubility of PVOH film. In films according to the disclosure, however, it is believed that the film is more resistant to the deteriorating effects of sodium carbonate and/or percarbonate than a homopolymer of PVOH due to the presence of the lactone rings present in the resin from the about 5 mol % of methyl acrylate. As other alkaline agents, such as other inorganic bleaches, would deteriorate PVOH film in the same way as sodium carbonate and/or percarbonate, the film according to the disclosure will be effective in delaying the release of such alkaline agents while still fully dissolving for the same reasons the film is effective in delaying the release of sodium carbonate and/or percarbonate.

Suitable inorganic bleaches for use with the delayed release films include salts of carbonate, borate, phosphate, sulfate and silicate, as well as perhydrate salts such as perborate, percarbonate, perphosphate, persulfate and persilicate salts. The inorganic bleaches are normally the alkali metal salts. The inorganic bleaches may be included as the crystalline solid without additional protection, e.g. without physical protection such as a coating on the solid particles or around an agglomerated mass of solid. Alternatively, the inorganic bleach can be coated or otherwise encapsulated as described herein.

In some embodiments of the disclosure, the inorganic bleach is in a coated form. One of the functions of the coating material is to prevent chemical interaction of the bleach with the water-soluble film that makes up the pouch that encloses the bleach, thereby enhancing the delayed release of the bleach by extending the amount of time the water-soluble film will remain intact after submersion in 40° C. water, relative to a water-soluble film pouch enclosing a bleach agent without a coating.

It has been found, as demonstrated in the examples, that coating the water-soluble film with a laminate material or an additional PVOH inner layer, rather than coating the bleach agent, does not prevent the interaction of the caustic active with the exterior film and, therefore, does not provide an enhanced delayed release, relative to a pouch or packet of the water-soluble film of the invention at a thickness equal to the thickness of the pouch or packet plus laminate.

It has further been found, as demonstrated in the examples, that a bleach coating consisting of polyethylene oxide, such as DuPont's N-80 PolyOx, was not fully effective at preventing chemical interaction of the caustic active with the water-soluble film. Further, carboxymethylcellulose coatings were found to be not fully soluble in water at 40° C. and therefore are not an ideal coating material for the intended purpose.

In embodiments wherein the inorganic bleach is coated with a suitable coating of the disclosure herein and enclosed in a water-soluble pouch and/or packet comprising a water-soluble film of the disclosure herein, the packets achieve a delayed release of the inorganic bleach of at least about 8 minutes, as determined by Bleach Compatibility Method A, or at least about 15 minutes, as determined by Bleach Compatibility Method B. Bleach coating materials can include polyethylene glycol (PEG) coatings. Suitable polyethylene glycols for coating materials according to the disclosure can be any polyethylene glycol having a molecular weight (in Daltons) in a range of about 1000 to about 20,000, or about 1000 to about 18000, or about 1000 to about 15000, or about 1000 to about 11,000, or about 2000 to about 10000, or about 3000 to about 9000, or about 4000 to about 8000, or about 5000 to about 7000, or about 6000. PEG coatings according to the disclosure can have a thickness in a range of about 20 mil to about 150 mil (about 0.5 mm to about 3.8 mm), about 20 mil to about 100 mil (about 0.5 mm to about 2.5 mm), about 20 mil to about 80 mil (about 0.5 mm to about 2.0 mm), or about 40 mil to about 60 mil (about 1.0 mm to about 1.5 mm).

PEG can be coated to compressed bleach tablets prior to the tablet being enclosed in the water-soluble pouch or packet. The PEG coating can be applied by sequentially dipping alternating sides of the compressed bleach tablet into molten PEG at a temperature in a range of about 65° C. to about 67° C., for example. The tablets are then cooled immediately by dipping the coated tablet into liquid nitrogen for a few seconds. The process of dipping the tablet into molten PEG followed by dipping the tablet into liquid nitrogen is repeated until the desired uniform coating thickness is achieved.

Alternatively, a first water-soluble packet or pouch comprising an inorganic bleach can be coated with a hard crystalline sugar coating, and the entire coated first pouch can be placed inside a second water-soluble packet or pouch comprising the delayed release water-soluble film of the disclosure. The hard crystalline sugar coating preferably is not applied directly to a bleach tablet or composition due to the increased reactivity of oxidizing agents within the bleach materials at the elevated temperatures used with molten sugar. Suitable hard crystalline sugar coatings of the disclosure can include a mixture of granulated sugar, corn syrup, and water. Hard crystalline sugar coatings can include a weight ratio of granulated sugar to corn syrup in a range of about 5:1 to about 1:5, about 1:4 to about 4:1, about 1:3 to about 3:1, about 1:2 to about 2:1, about 1:1, about 1:0.5, and/or about 1:0.1. In some embodiments, the coating mixture may be made free of corn syrup. The hard crystalline sugar coating can be applied by mixing a solution of granulated sugar, corn syrup, and water and then heating the solution to 150° C., followed by dipping of the water-soluble pouch or packet enclosing the bleach into the molten sugar solution, for example.

As described above, pouches can be multi-compartment. The pouches of the disclosure can be used in combination with secondary pouches or compartments that comprise useful compositions including, but not limited to, light duty and heavy duty liquid detergent compositions, detergent gels commonly used for laundry, and other laundry additives. Secondary pouches or compartments can be made from any film comprising a polymer resin that is readily soluble in water at 40° C. and, therefore, able to release the pouch or compartment component prior to the pouch or compartment comprising the delayed release film releasing the component enclosed therein. Suitable resins for water-soluble films of the secondary pouches or compartments include, but are not limited to, modified polyvinyl alcohols, polyacrylates, water-soluble acrylate copolymers, polyaminopropyl sulfonic acid and salts thereof, polyitaconic acid and salts thereof, polyacryamides, polyvinyl pyrrolidone, pullulan, cellulosics, including but not limited to carboxymethyl cellulose and hydroxypropyl methyl cellulose, water-soluble natural polymers including, but not limited to, guar gum, xanthan gum, carrageenan, and starch, water-soluble polymer derivatives including, but not limited to, modified starches, including ethoxylated starch and hydroxypropylated starch, poly(sodium acrylamido-2-methylpropane sulfonate), polymonomethylmaleate and salts thereof, copolymers thereof, and combinations of any of the foregoing with each other and/or with PVOH. Of course, the water-soluble films that make up secondary pouches or components can include other optional additive ingredients including, but not limited to, plasticizers, surfactants, emulsifiers, fillers, extenders, antiblocking agents, detackifying agents, antifoams, film formers and other functional ingredients, for example in amounts suitable for their intended purpose, as described herein in connection with the delayed release film.

Compositions for use in the present pouches may take the form of a liquid, solid or a powder. Liquid compositions may comprise a solid. Solids may include powder or agglomerates, such as micro-capsules, beads, noodles or one or more pearlized balls or mixtures thereof. Such a solid element may provide a technical benefit, through the wash or as a pre-treat, delayed or sequential release component; additionally or alternatively, it may provide an aesthetic effect.

In pouches comprising laundry, laundry additive and/or fabric enhancer compositions, the compositions may comprise one or more of the following non-limiting list of ingredients: fabric care benefit agent; detersive enzyme; deposition aid; rheology modifier; builder; organic bleach; bleach precursor; bleach booster; bleach catalyst; perfume and/or perfume microcapsules (see for example U.S. Pat. No. 5,137,646); perfume loaded zeolite; starch encapsulated accord; polyglycerol esters; whitening agent; pearlescent agent; enzyme stabilizing systems; scavenging agents including fixing agents for anionic dyes, complexing agents for anionic surfactants, and mixtures thereof optical brighteners or fluorescers; polymer including but not limited to soil release polymer and/or soil suspension polymer; dispersants; antifoam agents; non-aqueous solvent; fatty acid; suds suppressors, e.g., silicone suds suppressors (see: U.S. Publication No. 2003/0060390 A1, ¶65-77); cationic starches (see: US 2004/0204337 A1 and US 2007/0219111 A1); scum dispersants (see: US 2003/0126282 A1, ¶89-90); dyes; colorants; opacifier; antioxidant; hydrotropes such as toluenesulfonates, cumenesulfonates and naphthalenesulfonates; color speckles; colored beads, spheres or extrudates; clay softening agents. Any one or more of these ingredients is further described in described in European Patent Application Number 09161692.0 (filed Jun. 2, 2009), U.S. Publication Number 2003/0139312A1 (filed May 11, 2000) and U.S. Patent Application No. 61/229,981 (filed Jul. 30, 2009), each of which are assigned to the Procter & Gamble Company. Additionally or alternatively, the compositions may comprise surfactants and/or solvent systems, each of which is described below.

The detergent compositions can comprise from about 1% to 80% by weight of a surfactant, for example. Detersive surfactants utilized can be of the anionic, nonionic, zwitterionic, ampholytic or cationic type or can comprise compatible mixtures of these types. In one type of embodiment, surfactants are selected from the group consisting of anionic, nonionic, and cationic surfactants, and mixtures thereof. The compositions can be substantially free of betaine surfactants. Examples of detergent surfactants useful herein are described in U.S. Pat. Nos. 3,664,961; 3,919,678; 4,222,905; and 4,239,659. In another type of embodiment surfactants are selected from the group consisting of anionic surfactants, nonionic surfactants, and combinations thereof.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkyl ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants include: a) the sodium, potassium and ammonium alkyl sulfates, especially those obtained by sulfating the higher alcohols ($C_8$-$C_{18}$) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11}$-$C_{13}$ LAS.

Nonionic surfactants can be selected from one or more of those of the formula $R_1(OC_2H_4)_nOH$, wherein $R_1$ is a $C_{10}$-$C_{16}$ alkyl group or a $C_8$-$C_{12}$ alkyl phenyl group, and n is from 3 to about 80. Condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol, are specifically contemplated.

The solvent system in the present compositions can be a solvent system containing water alone or mixtures of organic solvents with water. Organic solvents can include 1,2-propanediol, ethanol, glycerol, dipropylene glycol, methyl propane diol and mixtures thereof. Other lower alcohols, $C_1$-$C_4$ alkanolamines such as monoethanolamine and triethanolamine, can also be used. Solvent systems can be absent, for example from anhydrous solid embodiments of the disclosure, but more typically are present at levels in the range of from about 0.1% to about 98%, preferably at least about 1% to about 50%, more usually from about 5% to about 25%.

Organic bleaches can include organic peroxyacids including diacyl and tetraacylperoxides, especially diperoxydodecanedioc acid, diperoxytetradecanedioc acid, and diperoxyhexadecanedioc acid. The organic peroxyacid can be dibenzoyl peroxide. The diacyl peroxide, especially dibenzoyl peroxide, can be present in the form of particles having a weight average diameter of from about 0.1 to about 100 microns, preferably from about 0.5 to about 30 microns, more preferably from about 1 to about 10 microns, for example. In embodiments, at least about 25% to 100%, or at least about 50%, or at least about 75%, or at least about 90%, of the particles are smaller than 10 microns, optionally smaller than 6 microns.

Other organic bleaches include the peroxy acids, particular examples being the alkylperoxy acids and the arylperoxy acids. Representatives include: (a) peroxybenzoic acid and its ring-substituted derivatives, such as alkylperoxybenzoic acids, but also peroxy-α-naphthoic acid and magnesium monoperphthalate; (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates; and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid).

Bleach activators can include organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 10 carbon atoms, in particular from 2 to 4 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC).

Bleach catalysts for use in the detergent composition herein include the manganese triazacyclononane and related complexes (U.S. Pat. Nos. 4,246,612, 5,227,084); Co, Cu, Mn and Fe bispyridylamine and related complexes (U.S. Pat. No. 5,114,611); and pentamine acetate cobalt(III) and related complexes (U.S. Pat. No. 4,810,410). Another description of bleach catalysts suitable for use herein can be found in U.S. Pat. No. 6,599,871, incorporated herein by reference.

Builders suitable for use in the detergent composition described herein include water-soluble builders, including citrates, carbonates, silicate and polyphosphates, e.g. sodium tripolyphosphate and sodium tripolyphosphate hexahydrate, potassium tripolyphosphate and mixed sodium and potassium tripolyphosphate salts.

Enzymes suitable for use in the detergent composition described herein include bacterial and fungal cellulases including CAREZYME and CELLUZYME (Novo Nordisk A/S); peroxidases; lipases including AMANO-P (Amano Pharmaceutical Co.), M1 LIPASE and LIPOMAX (Gist-Brocades) and LIPOLASE and LIPOLASE ULTRA (Novo); cutinases; proteases including ESPERASE, ALCALASE, DURAZYM and SAVINASE (Novo) and MAXATASE, MAXACAL, PROPERASE and MAXAPEM (Gist-Brocades); α and β amylases including PURAFECT OX AM (Genencor) and TERMAMYL, BAN, FUNGAMYL, DURAMYL, and NATALASE (Novo); pectinases; and mixtures thereof. Enzymes can be added herein as prills, granulates, or cogranulates at levels typically in the range from about 0.0001% to about 2% pure enzyme by weight of the cleaning composition.

Suds suppressers suitable for use in the detergent composition described herein include nonionic surfactants having a low cloud point. "Cloud point" as used herein, is a well known property of nonionic surfactants which is the result of the surfactant becoming less soluble with increasing temperature, the temperature at which the appearance of a second phase is observable is referred to as the "cloud point" (See Van Nostrand's Scientific Encyclopedia, $4^{th}$ Ed., p. 366, (1968)). As used herein, a "low cloud point" nonionic surfactant is defined as a nonionic surfactant system ingredient having a cloud point of less than 30° C., preferably less than about 20° C., and even more preferably less than about 10° C., and most preferably less than about 7.5° C. Low cloud point nonionic surfactants can include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants can include, for example, ethoxylated-propoxylated alcohol (e.g., BASF Poly-Tergent® SLF18) and epoxy-capped poly(oxyalkylated) alcohols (e.g., BASF Poly-Tergent® SLF18B series of nonionics, as described, for example, in U.S. Pat. No. 5,576,281).

Other suitable components for use in the detergent composition described herein include cleaning polymers having anti-redeposition, soil release or other detergency properties. Anti-redeposition polymers for use herein include acrylic acid containing polymers such as SOKALAN PA30, PA20, PA15, PA10 and SOKALAN CP10 (BASF GmbH), ACUSOL 45N, 480N, 460N (Rohm and Haas), acrylic acid/maleic acid copolymers such as SOKALAN CP5 and acrylic/methacrylic copolymers. Soil release polymers for use herein include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

Heavy metal sequestrants and crystal growth inhibitors are also suitable for use in the detergent, for example diethylenetriamine penta(methylene phosphonate), ethylenediamine tetra(methylene phosphonate) hexamethylenediamine tetra(methylene phosphonate), ethylene diphosphonate, hydroxy-ethylene-1,1-diphosphonate, nitrilotriacetate, ethylenediaminotetracetate, ethylenediamine-N,N'-disuccinate in their salt and free acid forms.

Suitable for use in the detergent composition described herein is also a corrosion inhibitor, for example organic silver coating agents (especially paraffins such as WINOG 70 sold by Wintershall, Salzbergen, Germany), nitrogen-containing corrosion inhibitor compounds (for example benzotriazole and benzimadazole—see GB-A-1137741) and Mn(II) compounds, particularly Mn(II) salts of organic ligands.

Other suitable components for use in the detergent composition herein include enzyme stabilizers, for example calcium ion, boric acid and propylene glycol.

Suitable rinse additives are known in the art. Commercial rinse aids for dishwashing typically are mixtures of low-foaming fatty alcohol polyethylene/polypropylene glycol ethers, solubilizers (for example cumene sulfonate), organic acids (for example citric acid) and solvents (for example ethanol). The function of such rinse aids is to influence the interfacial tension of the water in such a way that it is able to drain from the rinsed surfaces in the form of a thin coherent film, so that no water droplets, streaks, or films are left after the subsequent drying process. A review of the composition of rinse aids and methods for testing their performance is presented by W. Schirmer et al. in Tens. Surf. Det. 28, 313 (1991). European Patent 0 197 434 B1 to Henkel describes rinse aids which contain mixed ethers as surfactants. Rinse additives such as fabric softeners and the like are also contemplated and suitable for encapsulation in a film according to the disclosure herein.

In one embodiment, a pouch or packet can comprise two or more components wherein a first pouch or compartment comprising the water-soluble film of the disclosure comprises an alkaline agent and a second pouch or compartment can comprise a liquid laundry detergent. Non-limiting examples of liquid laundry detergents can include the ingredients presented in Table 1 below.

Additional embodiments are described in the following numbered paragraphs.

1. A water-soluble packet comprising a first sealed compartment containing a first composition, the first sealed compartment comprising a wall of water-soluble film, the water-soluble film comprising a polyvinyl alcohol (PVOH) and acrylate resin and the first composition comprising an alkaline agent.

2. The water-soluble packet of paragraph 1, wherein the polyvinyl alcohol and acrylate resin is a copolymer of polyvinyl alcohol and methyl acrylate.

3. The water-soluble packet of paragraph 2, wherein the methyl acrylate comprises from about 2 mol % to about 10 mol % of the copolymer.

4. The water-soluble packet of paragraph 2, wherein the methyl acrylate comprises about 5 mol % of the copolymer.

5. The water-soluble packet of any one of paragraphs 2 to 4, wherein the copolymer has a suitable viscosity and the water-soluble film has a suitable thickness to provide a desired delay in solubility of the film in water having a selected temperature prior to full dissolution of the film of the film in the water of the selected temperature.

6. The water-soluble packet of any one of the preceding paragraphs, wherein the water-soluble film remains intact for at least 3 minutes when submerged in water heated to a temperature of about 40° C., as determined by Bleach Compatibility Method A, and thereafter fully dissolves within 55 minutes.

7. The water-soluble packet of any of the preceding paragraphs, wherein the thickness of the water soluble film is in a range of about 3 mil to about 6 mil (about 0.076 mm to about 0.15 mm).

8. The water-soluble packet of any of the preceding paragraphs, wherein the PVOH copolymer viscosity is in a range of about 8 cPs to about 40 cPs.

TABLE 1

| | A Wt. % | B Wt. % | C Wt. % | D Wt. % | E Wt. % | F Wt. % |
|---|---|---|---|---|---|---|
| Glycerol | 3 | 5 | 3 | 0.6 | 5 | 5.3 |
| 1,2 Propanediol | 16 | 14 | 16 | | 12 | 10 |
| Citric acid | 1 | | 1 | | 0.5 | 0.5 |
| Isopropanol | | | | 7.7 | | |
| NaOH | 0.5 | | 3.5 | | 1 | |
| Marlipal $C_{12-14}EO_7$ | 22 | | 22 | | 14 | 20.1 |
| $C_{13-15}EO_9$ | 1 | 15 | 1 | | | |
| $C_{9-11}EO_9$ | | | | 72 | | |
| Linear alkyl benzene sulfonic acid[1] | 16 | 25 | 16 | | 23 | 24.6 |
| $C_{12-18}$ Fatty acid | 16 | 5 | 16 | | 6 | 16.4 |
| $C_{12-14}$ alkyl ethoxy 3 sulfate | | | | | 9 | |
| Enzymes | 2.5 | 1.5 | 2.5 | 2.0 | 1.5 | 2.0 |
| Polyethyleneimine ethoxylate PEI 600 E20 | 2 | | 2 | | | 3.0 |
| Diethylenetriamine Pentaacetic Acid | | 0.9 | | | 1 | |
| Dequest 2010 | 1.5 | | 1.5 | | 1 | 1.1 |
| Optical brightening agent | 1 | 1.2 | 1 | 0.5 | | 0.2 |
| $MgCl_2$ | | | | | | 0.2 |
| Potassium sulfite | | | | | 0.35 | 0.2 |
| Structurant | | 0.21 | | | 0.15 | |
| Silicone softening agent (PDMS) | | | | | | 2.5 |
| Water | 8 | 10 | 8 | 6 | 9 | |
| Miscellaneous (dyes, aesthetics, perfume etc) | To 100 | To 100 | To 100 | To 100 | To 100 | |
| Monoethanol amine | To pH 7.6 | To pH 7.5 | To pH 7.4 | To pH 7.6 | To pH 7.6 | To pH 7.6 |

[1]Suitable LAS also comprise an alkyl group comprising from about 9 to about 15 carbon atoms, in straight chain configuration.

9. The water-soluble packet of any of the preceding paragraphs, wherein the PVOH and methyl acrylate resin comprises about 35 to about 90 wt. % of the film, based on the total weight of the film.

10. The water-soluble packet of any of the preceding paragraphs, further comprising about 10 to about 50 phr of plasticizer, per 100 parts PVOH copolymer resin.

11. The water-soluble packet of paragraph 10, wherein the plasticizer comprises a material selected from the group consisting of sorbitol, glycerol, diglycerol, propylene glycol, ethylene glycol, diethyleneglycol, triethylene glycol, tetraethyleneglycol, polyethylene glycols up to MW 400, 2 methyl 1,3 propane diol, lactic acid, monoacetin, triacetin, triethyl citrate, 1,3-butanediol, trimethylolpropane (TMP), polyether triol, and combinations thereof.

12. The water-soluble packet of any of the preceding paragraphs, further comprising less than about 2 phr of surfactant, per 100 parts PVOH copolymer resin.

13. The water-soluble packet of paragraph 12, wherein the surfactant comprises a material selected from the group consisting of dialkyl sulfosuccinates, lactylated fatty acid esters of glycerol and propylene glycol, lactylic esters of fatty acids, sodium alkyl sulfates, polysorbate 20, polysorbate 60, polysorbate 65, polysorbate 80, alkyl polyethylene glycol ethers, lecithin, acetylated fatty acid esters of glycerol and propylene glycol, sodium lauryl sulfate, acetylated esters of fatty acids, myristyl dimethylamine oxide, trimethyl tallow alkyl ammonium chloride, quaternary ammonium compounds, salts thereof and combinations of any of the forgoing.

14. The water-soluble packet of any of the preceding paragraphs, further comprising a second sealed compartment, the second sealed compartment containing a second composition, wherein the first sealed compartment and the second sealed compartment are optionally conjoined about a partitioning wall.

15. The water-soluble packet of any of the preceding paragraphs, wherein the first composition and the second composition are combinations of compositions selected from the group consisting of: liquid, liquid; liquid, powder; and powder, powder.

16. The water-soluble packet of any of the preceding paragraphs, wherein the alkaline agent comprises an inorganic bleach.

17. The water-soluble packet of paragraph 16, wherein the inorganic bleach comprises sodium carbonate, percarbonate, or a combination thereof.

18. The water-soluble packet of paragraph any one of the preceding paragraphs, wherein the alkaline agent is coated with a coating material comprising polyethylene glycol.

19. The water-soluble packet of paragraph 18, wherein the coating has a thickness in a range of about 20 mil to about 150 mil (about 0.5 mm to about 3.8 mm).

20. The water-soluble packet of paragraph 18 or paragraph 19, wherein the first sealed compartment remains intact for at least 8 minutes when submerged in water heated to a temperature of about 40° C., as measured by Bleach Compatibility Method A.

21. The water-soluble packet of any one of paragraphs 1-17, wherein the alkaline agent is enclosed in a second packet, and the second packet is coated with a hard crystalline sugar coating.

22. The water-soluble packet of paragraph 21, wherein the hard crystalline sugar coating comprises a mixture of granulated sugar and corn syrup/

23. The water-soluble packet of paragraph 21 or paragraph 22, wherein the hard crystalline sugar coating comprises granulated sugar and corn syrup in a weight ratio in a range of about 5:1 to about 1:5.

24. A method of making a packet for delayed solubility and delayed release of an alkaline component therein in hot water of a selected temperature, comprising:

preparing a packet comprising a sealed compartment containing an alkaline composition, the sealed compartment made from a water-soluble film comprising a copolymer of polyvinyl alcohol (PVOH) and methyl acrylate;

selecting the mol % methyl acrylate in the copolymer, the viscosity of the copolymer, and the thickness of the film to provide a desired delay in solubility of the film in hot water of the selected temperature prior to full dissolution of the film of the film in the hot water of the selected temperature.

25. A water-soluble packet, comprising: a first sealed compartment containing a first composition comprising an alkaline agent comprising a mixture of sodium carbonate and percarbonate, the first sealed compartment comprising a water-soluble film comprising a polyvinyl alcohol (PVOH) and methyl acrylate resin comprising about 5 mol % methyl acrylate and having a thickness of about 3 mil to about 6 mil (about 0.076 mm to about 0.15 mm), and the packet further comprising a second sealed compartment containing a second composition, wherein the first sealed compartment and the second sealed compartment are optionally conjoined about a portioning wall, wherein the second composition comprises a laundry additive and wherein the first sealed compartment releases the first composition at least 3 minutes after being submerged in water-heated to about 40° C., as measured by Bleach Compatibility Method A, and the water-soluble film of the first sealed component fully dissolves within 55 minutes.

EXAMPLES

Determination of Bleach Compatibility Method A (Method A)

A small, nominal 5 mil (127 μm), water-soluble film pouch is filled with either 5.8 g of 1:1 (wt %) sodium carbonate and sodium percarbonate mixed powder or a 10 g compressed tablet of the same material, and heat sealed. The compressed bleach tablets can comprise stearic acid as a binding agent and are made with compression techniques well known to those skilled in the art. The bleach powder materials are available from Solvay Chemicals. The pouch is secured using a vinyl coated 0.5 inch metal mesh cage and submerged into a 600 ml beaker containing 500 ml of 40° C. deionized water, with stirring. The water is stabilized to pH 7 before submerging the metal mesh cage containing the pouch. After the pouch is submerged, the pH of the water was monitored using a pH probe and recorded every minute until a pH of 9.5 or higher is reached, or until 20 minutes have elapsed. The integrity and dissolution behavior of the pouch is observed and recorded. Ideal behavior in 40° C. water is marked by a sudden increase in pH through the release of the active materials from the pouch at about 9 to 12 minutes from the start of the test (submerging of the pouch). This ideal behavior corresponds to an active release delay of about 15 to 20 minutes within a commercially-available automatic laundry machine cycle using nominally 40° C. wash water.

Determination of Bleach Compatibility Method B (Method B)

The bleach compatibility of water-soluble packets prepared from water-soluble film are tested in a Siemens S16-79 washing machine using the program Koch/Bunt (cotton/colored), or an equivalent. The SIEMENS brand S16-79 automatic washing machine has a 65 liter drum capacity and variable temperature selection. The test samples are prepared as described above for Bleach Compatibility Method A. The temperature of the wash water is either 20° C., 40° C., or 60° C. The water hardness is 250 ppm $CaCO_3$ (14° d, German degrees hardness). The wash load is 3 kg, consisting of 2 bed sheets (1.5×1.5 m ISO 2267), 4 pillow cases (0.8×0.8 m ISO 2267), and 3 huckaback towels, cotton bleached. The dissolution time for Method B corresponds to the time at which a pH of 9.5 or higher is reached, as measured by a pH probe. Ideal behavior is marked by a sudden increase in pH through the release of the active materials from the pouch at about 15 to 20 minutes within a commercially-available automatic laundry machine cycle using nominally 40° C. wash water.

Determination of Film Solubility Characteristics (MSTM 205)

Figure 1:
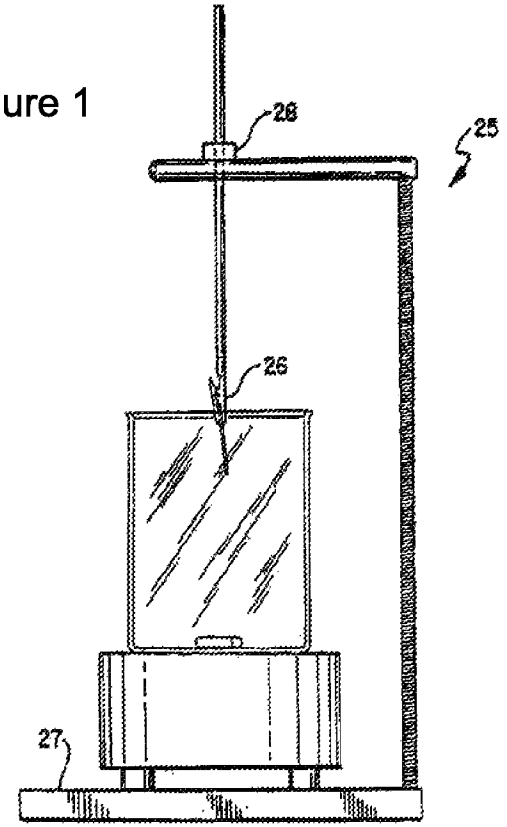
FIG. 1 is a perspective view of a test apparatus used to determine the water disintegration and dissolution times of film samples according to MSTM 205 described herein.
Figure 2:
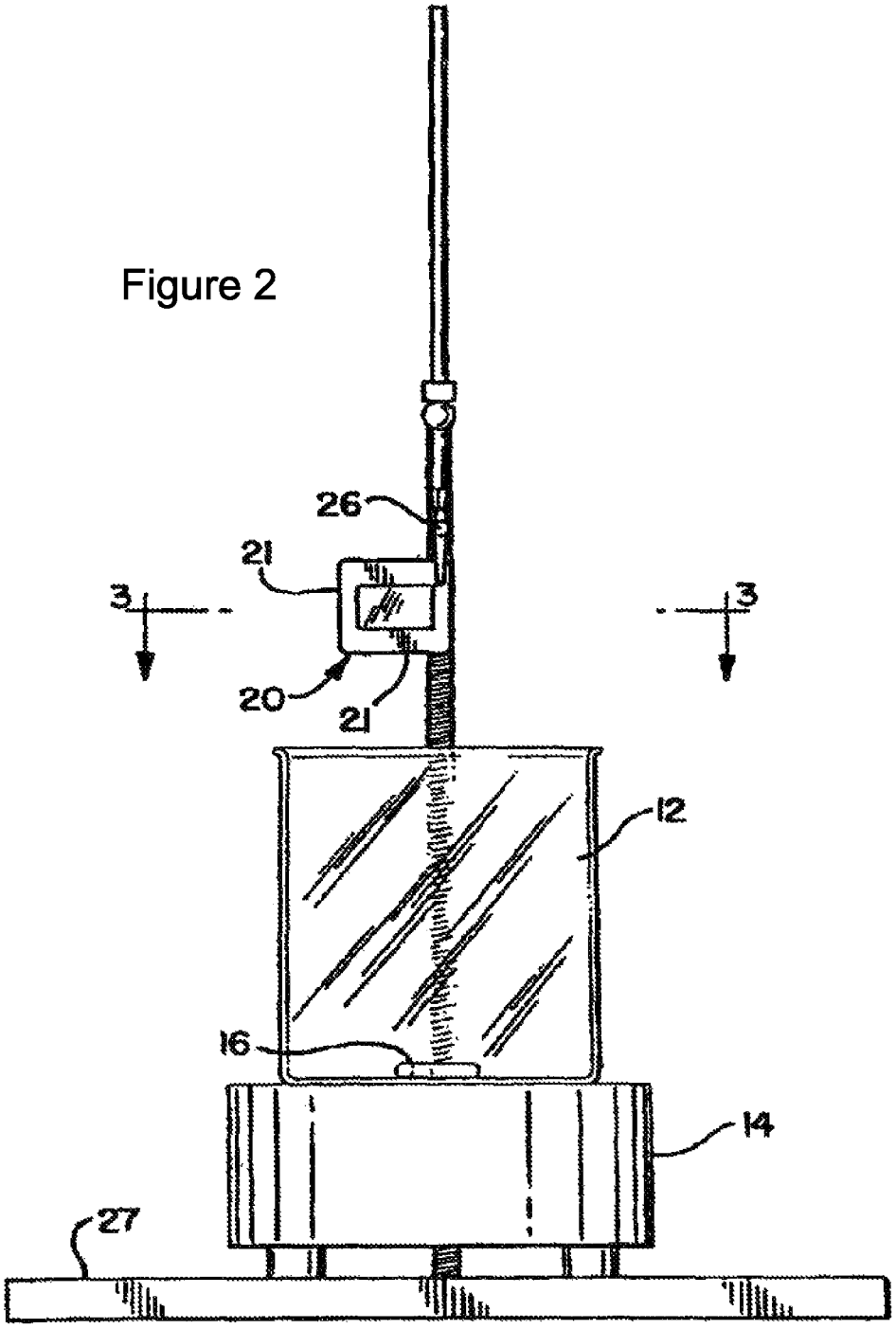
FIG. 2 is a perspective view of the test apparatus and test set-up illustrating the procedure for determining the water-solubility of film samples according to MSTM 205 described herein.

Film solubility can be measured by MONOSOL Test Method 205 (MSTM 205), which is disclosed with reference to FIGS. 1-3 herein.

MSTM 205

Apparatus and Materials:

600 mL Beaker 12

Magnetic Stirrer 14 (Labline Model No. 1250 or equivalent)

Magnetic Stirring Rod 16 (5 cm)

Thermometer (0 to 100° C., ±1° C.)

Template, Stainless Steel (3.8 cm×3.2 cm)

Timer, (0-300 seconds, accurate to the nearest second)

Polaroid 35 mm Slide Mount 20 (or equivalent)

MONOSOL 35 mm Slide Mount Holder 25 (or equivalent, see FIG. 1)

Distilled Water

Test Specimen:

1. Cut three test specimens from film sample using stainless steel template (i.e., 3.8 cm×3.2 cm specimen). If cut from a film web, specimens should be cut from areas of web evenly spaced along the transverse direction of the web.

2. Lock each specimen in a separate 35 mm slide mount 20.

3. Fill beaker 12 with 500 mL of distilled water. Measure water temperature with thermometer and, if necessary, heat or cool water to maintain temperature at 40° C. (about 104° F.

4. Mark height of column of water. Place magnetic stirrer 14 on base 27 of holder 25. Place beaker 12 on magnetic stirrer 14, add magnetic stirring rod 16 to beaker 12, turn on stirrer 14, and adjust stir speed until a vortex develops which is approximately one-fifth the height of the water column. Mark depth of vortex.

5. Secure the 35 mm slide mount 20 in the alligator clamp 26 of the MONOSOL 35 mm slide mount holder 25 (FIG. 1) such that the long end 21 of the slide mount 20 is parallel to the water surface, as illustrated in FIG. 2. The depth adjuster 28 of the holder 25 should be set so that when dropped, the end of the clamp 26 will be 0.6 cm below the surface of the water. One of the short sides 23 of the slide mount 20 should be next to the side of the beaker 12 with the other positioned directly over the center of the stirring rod 16 such that the film surface is perpendicular to the flow of the water, as illustrated in FIG. 3.

6. In one motion, drop the secured slide and clamp into the water and start the timer. Disintegration occurs when the film breaks apart. When all visible film is released from the slide mount, raise the slide out of the water while continuing to monitor the solution for undissolved film fragments. Dissolution occurs when all film fragments are no longer visible and the solution becomes clear.

Data Recording:

The results should include the following:

complete sample identification;

individual and average disintegration and dissolution times; and water temperature at which the samples were tested.

The time for complete dissolution (in seconds) is obtained.

Example 1: Bleach Compatibility

| Component | Description | 1 |
|---|---|---|
| PVOH Copolymer (5 mol % methyl acrylate)) | 18 cPs, DH 98-99 | 100 |
| Sorbitol (70% active), MP Diol, Glycerin | Plasticizer | 18.37 |
| Process Aids | surfactant | 2.03 |
| | Lubricant/release agent | 0.12 |
| | Starch | 2.57 |
| | Clarity stabilizer | 0.21 |
| Dissolution Time at 40° C. (minutes) | | 1:20 |

A water-soluble film was prepared with the ingredients identified in the table above in the amounts shown (phr). 5 mil (127 μm) thick water-soluble films were cast according to formula 1, and were tested for solubility characteristics according to MSTM 205 as described above. Films were then formed into pouches and 5.8 g of a 1:1 (wt. %) mixture of sodium carbonate and percarbonate was enclosed within the pouches and the pouches were heat sealed. The bleach compatibility of the pouches were determined according to Bleach Compatibility Method A and Bleach Compatibility Method B. The film according to Example 1 demonstrated a release of the bleach component in after having been submerged in water heated to a temperature of 40° C. for 3 min, as determined by Method A, and after 9 minutes, as determined by Method B.

Example 1 demonstrates a film according to the disclosure that is fully soluble in water heated to a temperature of 40° C. Example 1 further demonstrates that a pouch made of a film of the disclosure can provide a delayed release of alkaline contents of 3 minutes as determined by Method A, that corresponds to 9 minutes in a washing machine, as determined by Method B.

Comparative Example 2: Dissolution Behavior of Fully Hydrolyzed PVOH Homopolymers

| Component | Description | 1 | 2 | 3 | 4 |
|---|---|---|---|---|---|
| PVOH Copolymer (5 mol % methyl acrylate)) | 18 cPs, 98-99% DH | 100 | | | |

-continued

| Component | Description | 1 | 2 | 3 | 4 |
|---|---|---|---|---|---|
| PVOH | 6 cPs, 98% DH | | 100 | | |
| PVOH | 10 cPs, 98% DH | | | 100 | |
| PVOH | 30 cPs, 98% DH | | | | 100 |
| Sorbitol (70% active), MP Diol, Glycerin | Plasticizer | 18.37 | 18.37 | 18.37 | 18.37 |
| Process Aids | surfactant | 2.03 | 2.03 | 2.03 | 2.03 |
| | Lubricant/release agent | 0.12 | 0.12 | 0.12 | 0.12 |
| | Starch | 2.57 | 2.57 | 2.57 | 2.57 |
| | Clarity stabilizer | 0.21 | 0.21 | 0.21 | 0.21 |
| Time to pH 9.5 | Method A | 8.25 | 2.98 | not applicable, will not be soluble | 16.01 |
| Solubility behavior at 40° C. | | Desired delayed solubility | Dissolves faster than acceptable | Will be insoluble | Does not fully dissolve after releasing packet content |

Water-soluble films were prepared with the ingredients identified in the table above in the amounts shown (phr). 5 mil (127 μm) thick water-soluble films were cast according to formulae 1, 2 and 4, formed into pouches and 5.8 g of a 1:1 (wt. %) mixture of sodium carbonate and percarbonate was enclosed within the pouches and the pouches were heat sealed. The pouches were tested for pH delay according to Method A as described above.

Comparative Example 2 demonstrates that PVOH homopolymers are unsuitable for applications that require both good film processability and complete dissolution at 40° C. Low viscosity (6 cPs) films, cast from film formula 2, demonstrated faster than desired solubility at 40° C. but with considerable variability indicating that the PVOH resin is in a transition region. Films have varying molecular weight averages depending on the manufacturer (and, therefore varying viscosity) resulting in varying solubility properties. Thus, in the observed transition region (about 6 cPs) the PVOH resin may exhibit a solubility that is too fast or too slow based on minor manufacturer processing variations. As the viscosity of the water-soluble resin increased, for example films cast from film formula 4 (30 cPs), the resulting films demonstrated insolubility at 40° C. A film cast from film formula 3, having a viscosity of 10 cPs will also be insoluble and therefore will not exhibit a delayed release in water heated to a temperature of 40° C.

Comparative Example 3: Dissolution Behavior of Alternate Resins

| Component | Description | 1 | 5 | 6 | 7 | 8 | 9 | 10 |
|---|---|---|---|---|---|---|---|---|
| PVOH Copolymer (5 mol % methyl acrylate)) | 18 cPs, 98-99% DH | 100 | | | | | | |
| PVOH | 17 cPs, 92% DH | | 100 | | | | | |
| PVOH | 29 cPs, 96% DH | | | 100 | | | | |
| PVOH/<5 mol % methyl methacrylate copolymer | 28 cPs, fully hydrolyzed | | | | 100 | | | |
| PVOH/<5 mol % methyl methacrylate copolymer | 17 cPs, fully hydrolyzed | | | | | 100 | | |
| PVOH homopolymer | 6 cPs, 98% DH | | | | | | 100 | |
| PVOH homopolymer | 30 cPs, 98% DH | | | | | | | 100 |
| Sorbitol (70% active), MP Diol, Glycerin | Plasticizer | 18.37 | 18.37 | 18.37 | 18.37 | 18.37 | 18.37 | 18.37 |

-continued

| Component | Description | 1 | 5 | 6 | 7 | 8 | 9 | 10 |
|---|---|---|---|---|---|---|---|---|
| Process Aids | surfactant | 2.03 | 2.03 | 2.03 | 2.03 | 2.03 | 2.03 | 2.03 |
| | Lubricant/ release agent | 0.12 | 0.12 | 0.12 | 0.12 | 0.12 | 0.12 | 0.12 |
| | Starch | 2.57 | 2.57 | 2.57 | 2.57 | 2.57 | 2.57 | 2.57 |
| | Clarity stabilizer | 0.21 | 0.21 | 0.21 | 0.21 | 0.21 | 0.21 | 0.21 |
| Time to pH 9.5 (packet releases content) | Method A | | | | | | | |
| Solubility behavior at 40° C. | Method A | Fully Soluble | Inadequate solubility - will not fully dissolve | Inadequate solubility - did not dissolve | Inadequate solubility - did not dissolve | Inadequate solubility - did not fully dissolve | Too soluble | Inadequate solubility - did not dissolve |
| Point A Time at 40° C. in presence of carbonate (minutes) | Method A | 3:30 | N/A | 16:18 | N/A pouch did not release | 13:12 | 3:06 with disintegration | N/A pouch did not release |

Water-soluble film was prepared with the ingredients identified in the table above in the amounts shown (phr). 5 mil (127 μm) thick water-soluble films were cast according to formulae 6-10. Films were then formed into pouches, 5.8 g of a 1:1 (wt. %) mixture of sodium carbonate and percarbonate was enclosed within each pouch, and the pouches were heat sealed. The pouches were then tested for bleach compatibility according to Method A.

Comparative Example 3 demonstrates the bleach compatibility of PVOH homopolymers with a moderate degree of hydrolysis (5 and 6), fully hydrolyzed PVOH homopolymers having a viscosity less than 5 cPs (9), fully hydrolyzed PVOH homopolymers having a viscosity greater than 5 cPs (10), and modified PVOH resins comprising methyl acrylate in amounts less than 5 mol % (7 and 8). Comparative Example 3 shows that PVOH homopolymer with a moderate degree of hydrolysis (6) display inadequate solubility and did not fully dissolve in 55 minutes or less, as would be required for a washing machine application. Films cast from formula 5 containing a PVOH homopolymer with a moderate degree of hydrolysis (5) will also display inadequate solubility and will not fully dissolve in 55 minutes or less, as would be required for a washing machine application. Comparative Example 3 further shows that, as expected based on the solubility data from MSTM 205, fully hydrolyzed PVOH homopolymers having a viscosity less than 5 cPs (9), are too readily soluble and disintegrate in water heated to a temperature of 40° C., releasing the contents of the pouch. Similarly, as expected from the solubility testing using MSTM 205, fully hydrolyzed PVOH homopolymers having a viscosity greater than 5 cPs (10) display inadequate solubility and do not even release the pouch contents into the water heated to a temperature of 40° C. Finally, Comparative Example 3 further demonstrates that films comprising modified PVOH resins comprising methyl acrylate in amounts less than 5 mol % do not display adequate solubility and do not fully dissolve in 55 minutes or less (7 and 8). Further, the pouch made from film formula 7 also did not even release the pouch contents into the water heated to a temperature of 40° C.

Example 4: Coatings Laminate Material or an Additional PVOH Inner Layer, Polyethylene Oxide, Carboxymethylcellulose Coatings, Peg, Sugar

| | Coating Material | | | | | |
|---|---|---|---|---|---|---|
| | 11: Laminate - 3 mil of film according to film formula 1 | 12: Laminate - 3 mil film formula 12 | 13: PVOH coating - 3 mil of film according to film formula 6 | 14: Poly Ox Coating | 15: CMC coating | 16: Sugar Coating |
| Point A Time | 8 min | 5 min | Did not dissolve | 8 min | CMC did not dissolve | 11:54 |

Water soluble films were prepared according to the formulations described above for film formulation 1. A 5 mil (127 μm) water-soluble film was cast according to film formula 1 and was laminated with either 3 mil (76 μm) of a film according to film formula 1 (11) or 3 mil (76 μm) of formula 12 (12) and formed into a pouch. The laminate film according to formula 12 (12) having a thickness of 3 mil (76 μm) was cast from a water-soluble mixture comprising 100 phr of a PVOH resin comprising 4 mol % sodium aminopropyl sulfonate with a viscosity of 12 cPs and a degree of hydrolysis of greater than 95%, 26.24 phr plasticizers, 0.53 phr surfactants, 0.03 phr defoamer, 1.33 phr filler, 2.67 phr starch, 0.67 phr lubricant/release agent, and 0.27 phr of a stabilizer. The pouches were filled with 5.8 g of a 1:1 (wt. %) mixture of sodium carbonate and percarbonate, heat sealed, and tested according to Method A. The control pouch (11) had a Point A Time of about 8 minutes. The pouch of formula 12 (12) had a Point A Time of about 5 minutes. Thus, pouches (11) and (12) of Example 4 demonstrate that laminating a pouch of the invention with a more ionic film, such as a film of formula 12, does not result in an improvement of the delayed release of the pouch contents. Pouch (11) of Example 4 further demonstrates that an increase in the thickness of the water-soluble film results in an increase in the dissolution time and, therefore, the delayed release of the pouch contents. Pouch (11) (nominally 8 mils thick) had a Point A Time of about 8 minutes whereas a pouch of the same film having a thickness of 5 mils (Example 2, formula 1) had a Point A Time of about 3.5 minutes.

A 5 mil (127 μm) water-soluble film of the disclosure, according to film formula 1, was coated with 3 mil (76 μm) of a PVOH resin of an intermediately hydrolyzed PVOH homopolymer having a viscosity of 29 cPs, according to film formula 6 in Example 2 and formed into a pouch (13). The pouch was filled with 5.8 g of a 1:1 (wt. %) mixture of sodium carbonate and percarbonate, heat sealed and tested according to Method A. The water-soluble film did not fully dissolve in 55 minutes or less, thereby demonstrating that coating the water-soluble film of the invention with a PVOH homopolymer resin is unsuitable for delayed release laundry applications.

A wetted 10 g compressed tablet of a 1:1 (wt. %) mixture of sodium carbonate and percarbonate with stearic acid as a binding agent was powder coated with Dow's N-80 PolyOx material (nonionic, high molecular weight water-soluble poly (ethylene oxide) polymer, viscosity range of 65 to 115 mPA·s for a 5% solution at 25° C.). The coating was allowed to dry and the tablet was then heat sealed into a 5 mil (127 μm) thick water-soluble pouch according to film formula 1 (14). The pouch was then tested according to Method A. The PolyOx coating was found to be ineffective at providing enhanced compatibility and reducing premature basification of the was water. The tablets coated with PolyOx demonstrated inconsistent results due to the powdered nature of the PolyOx coating. Because PolyOx is not melt-processable the tablets were first wetted to improve adhesion of the PolyOx coating. Such a wetting process is not desirable because it initiates activation of the bleach compounds. The activated bleach causes in pin-hole formation in the water-soluble of the water-soluble pouch containing it during storage (i.e. while on a store shelf before purchase). Pin-hole formation leads to a decrease in the delayed release properties of the film. Further, the powdered nature of the PolyOx resulted in poor storage integrity (the powdered coating can chip/be rubbed off of the bleach tablet) which further resulted in inconsistent delayed release properties.

A wetted 10 g compressed tablet of a 1:1 (wt. %) mixture of sodium carbonate and percarbonate with stearic acid as a binding agent was powder coated with Cekol 300 carboxymethyl cellulose (CMC). Cekol 300 has a viscosity of 200-400 cPs and a degree of substitution between 0.60 to 0.95. The coating was allowed to dry and the tablet was then heat sealed into a 5 mil (127 μm) thick water-soluble pouch according to film formula 1 (15). The pouch was then tested according to Method A. The CMC coating was found to be not soluble enough for this application.

A water-soluble film having a thickness of 3 mil (76 μm) was cast from a water-soluble mixture comprising 100 phr of a PVOH resin comprising 5 mol % methyl acrylate with a viscosity of 18 cPs and a degree of hydrolysis of greater than 99% (i.e. fully hydrolyzed), 48.78 phr plasticizers, 6.02 phr surfactants, 0.7 phr defoamer, 3.7 phr filler, 3.41 phr starch, and 0.2 phr of a stabilizer. The film was formed into a pouch, filled with 5.8 g of a 1:1 (wt. %) mixture of sodium carbonate and percarbonate and heat sealed. The pouch was then dipped into a molten sugar mixture comprising granulated sugar, corn syrup and water heated to 150° C. The ratio of granulated sugar to corn syrup was about 3:1. The molten sugar was allowed to cool. The pouch was then encapsulated in a 5 mil (127 μm) thick water-soluble pouch according to film formula 1 (16) and the bleach compatibility was measured according to Method A. The hard, crystalline, sugar coated bleach pouch (16) had demonstrated good delay release properties with a point A time of about 12 minutes and good dissolution properties.

Example 5: Dissolution of Alkaline Bleach Tablets

| | A: Tablet, no pouch | B: Tablet no coating in pouch of film formula 1 | C: Tablet coating PEG 6000 | D: Tablet coated with Peg 6000 in pouch of film formula 1 |
|---|---|---|---|---|
| Point A Time (min) | 0 | 3:12 min | 1 min | 8:40 min |

Figure 4:
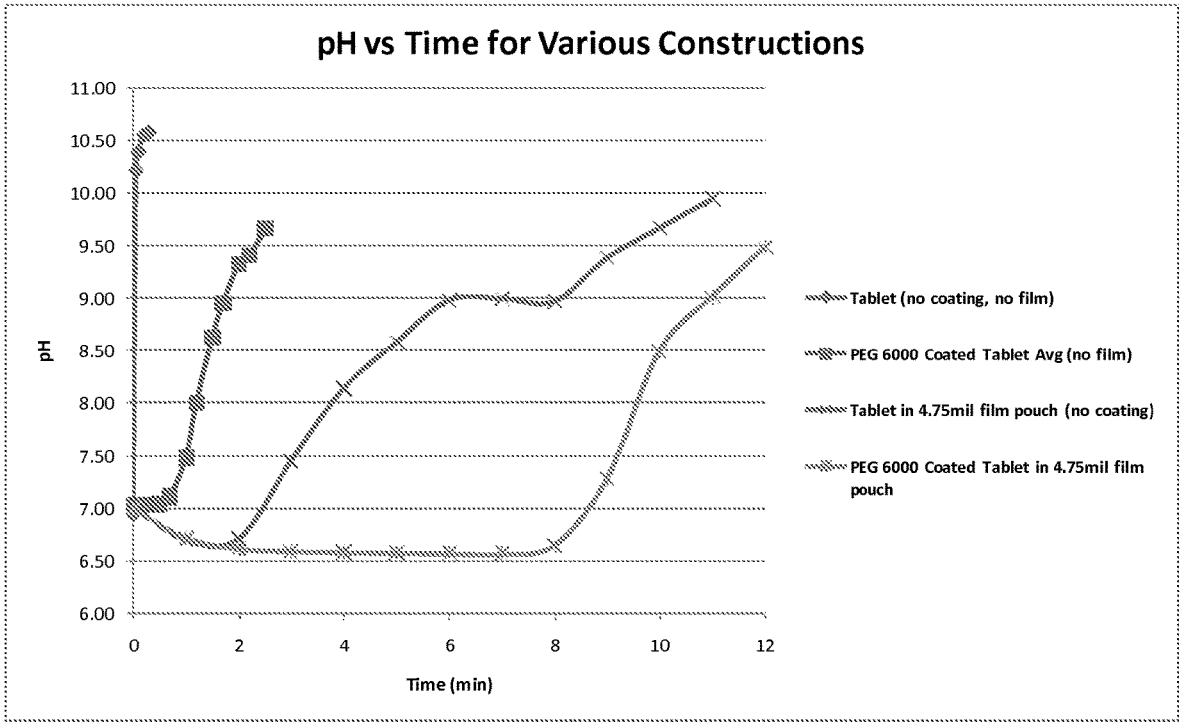
FIG. 4 is a plot of the pH vs. time for a tablet of 10 g compressed tablet of sodium carbonate and sodium percarbonate (1:1 wt. %), a 10 g compressed tablet of sodium carbonate and sodium percarbonate (1:1 wt. %) coated with polyethylene glycol (PEG MW 6,000), a 10 g compressed tablet of sodium carbonate and sodium percarbonate (1:1 wt. %) contained within a water-soluble film pouch according to the disclosure, and a 10 g compressed tablet of sodium carbonate and sodium percarbonate (1:1 wt. %) coated with PEG (MW 6,000) and contained within a water-soluble film pouch according to the disclosure.

Four variations of a 10 g alkaline bleach tablet were tested for dissolution time. The tablets tested were 10 g compressed tablets of a 1:1 (wt. %) mixture of sodium carbonate and percarbonate, with stearic acid as a binding agent. The four variations that were tested were A) an uncoated tablet not enclosed in a pouch, B) an uncoated tablet enclosed in a pouch comprising the water-soluble film of film formulation 1, C) a tablet coated with 65 mil (1.65 mm) of PEG (MW=6000) and D) a tablet coated with 65 mil (1.65 mm) of PEG 6000 enclosed in a pouch comprising the water-soluble film of film formulation 1. The pouches had a water-soluble film thickness of about 4.75 mil (120 μm). The tablets and pouches enclosing the tablets were tested according to Method A. The results are shown in the above table and FIG. 4. FIG. 4 shows that the uncoated tablet not enclosed in a pouch (A) dissolves in less than 1 minute after being placed in water at a temperature of 40° C. FIG. 4 further shows that the same tablet, when enclosed in a water-soluble pouch of the invention (C), begins to be released about 3 minutes after submerging the pouch in water heated to a temperature of 40° C. Further, FIG. 4 shows that a tablet coated with PEG 6000 not enclosed in a pouch (B) begins to dissolve about 1 minute after being submerged in water heated to a temperature of 40° C. and that a tablet coated with PEG 6000 and enclosed in a water-soluble pouch of the invention (D) does not begin to basify the water heated to a temperature of 40° C. until at least 8 minutes after the pouch has been submerged in the water. These results show that although the PEG 6000 coating does provide a small delayed release feature to the tablet (about 1 minute; tablet A vs. table C), the enhanced delayed release time demonstrated by the pouch enclosing the coated tablet (D, 8 minutes vs. 3 minutes for the pouch enclosing the uncoated tablet B), is a result of the enhanced chemical stability of the pouch when the pouch is not in contact with the alkaline material of the bleach tablet.

Example 6: Storage Stability

| | Aging time | | | |
|---|---|---|---|---|
| Description | 0 Weeks | 2 Weeks | 4 Weeks | 6 Weeks |
| Pouch of film formulation 1 with uncoated tablet enclosed Ambient Conditions | Point A time: 3:12 min | Point A time: 3:02 min | Point A time: 2:46 min | Point A time: 3:00 min |

-continued

| Description | Aging time | | | |
|---|---|---|---|---|
| | 0 Weeks | 2 Weeks | 4 Weeks | 6 Weeks |
| Pouch of film formulation 1 with uncoated tablet enclosed 38° C., 80% Relative Humidity | N/A | Point A time: 2:25 min | Point A time: 2:09 min | Point A time: 2:16 min |
| Pouch of film formulation 1 with PEG 6000 table enclosed Ambient Conditions | Point A time: 8:40 min | Point A time: 9:27 min | Point A time: 8:42 min | Point A time: 10:33 min |
| Pouch of film formulation 1 with PEG 6000 tablet enclosed 38° C., 80% Relative Humidity | N/A | Point A time: 11:27 min | Point A time: 9:01 min | Point A time: 7:57 min |

Water-soluble film was prepared according to film formulation 1. 5 mil (127 μm) thick water-soluble films were cast according to formula 1, formed into pouches and a 10 g tablet of a 1:1 (wt. %) mixture of sodium carbonate and percarbonate, with stearic acid as a binding agent (uncoated, or coated with a 65 mil coating of PEG 6000) were enclosed within the pouches and the pouches were heat sealed. The bleach compatibility of the pouches were determined according to Bleach Compatibility Method A. Pouches were stored up to 6 weeks under either ambient conditions (23° C. and 35 RH) or at 38° C. and 80% relative humidity. Example 6 demonstrates that the water-soluble films of the disclosures maintain an acceptable delayed release profile over 6 weeks when stored under ambient conditions or at a temperature of 38° C. and 80% relative humidity. It is believed that in the case of the uncoated bleach, hydrolysis of the lactone rings by moisture in the bleach would increase the solubility of the water-soluble films (i.e., the films resemble a partially hydrolyzed PVOH), however the bleach component reacts with the film in the presence of moisture to hydrolyze the film resin which leads to a decrease in solubility and thus, the effects counter-act one another. As a result, the moisture from the air does not significantly affect the solubility of the film and the dissolution time remains relatively stable over time. It is further believed that in the case of the coated bleach tablets, any moisture from the bleach tablet cannot interact with the water-soluble resin and therefore the water-soluble film demonstrates enhanced initial solubility. Further, the film with the coated bleach table is more susceptible to moisture from the atmosphere during storage because there is no counter-acting effect from the bleach tablet. Thus, the solubility of the water-soluble film with the coated bleach tablet increases more significantly over storage. However, even with the increase in solubility, the water-soluble films with coated bleach tablets still maintain an acceptable delayed release profile.

The foregoing description is given for clearness of understanding only, and no unnecessary limitations should be understood therefrom, as modifications within the scope of the invention may be apparent to those having ordinary skill in the art.

Throughout this specification and the claims which follow, unless the context requires otherwise, the word "comprise" and variations such as "comprises" and "comprising" will be understood to imply the inclusion of a stated integer or step or group of integers or steps but not the exclusion of any other integer or step or group of integers or steps.

Throughout the specification, where compositions are described as including components or materials, it is contemplated that the compositions can also consist essentially of, or consist of, any combination of the recited components or materials, unless described otherwise. Likewise, where methods are described as including particular steps, it is contemplated that the methods can also consist essentially of, or consist of, any combination of the recited steps, unless described otherwise. The invention illustratively disclosed herein suitably may be practiced in the absence of any element or step which is not specifically disclosed herein.

The practice of a method disclosed herein, and individual steps thereof, can be performed manually and/or with the aid of or automation provided by electronic equipment. Although processes have been described with reference to particular embodiments, a person of ordinary skill in the art will readily appreciate that other ways of performing the acts associated with the methods may be used. For example, the order of various of the steps may be changed without departing from the scope or spirit of the method, unless described otherwise. In addition, some of the individual steps can be combined, omitted, or further subdivided into additional steps.

All patents, publications and references cited herein are hereby fully incorporated by reference. In case of conflict between the present disclosure and incorporated patents, publications and references, the present disclosure should control.

What is claimed:

1. A water-soluble packet comprising a first sealed compartment containing a first composition, the first sealed compartment comprising a wall of water-soluble film, the water-soluble film comprising a copolymer of polyvinyl alcohol (PVOH) and acrylate resin consisting of vinyl alcohol units, vinyl acetate units, and acrylate units, and the first composition is alkaline such that 5.8 g of the composition in 500 ml of 40° C. deionized water yields a pH of 9.5 or higher, wherein sufficient pendant carboxyl groups from the acrylate in the copolymer are in the form of lactone rings such that the water-soluble film remains intact for at least 8 minutes when submerged in water heated to a temperature of about 40° C., as determined by Bleach Compatibility Method A, and thereafter the film fully dissolves within 55 minutes, and the packet further comprising an alkaline sensitive material partitioned from the first sealed compartment.

2. The water-soluble packet of claim 1, wherein the polyvinyl alcohol and acrylate resin is a copolymer of polyvinyl alcohol and methyl acrylate.

3. The water-soluble packet of claim 2, wherein the methyl acrylate comprises from about 2 mol % to about 10 mol % of the copolymer.

4. The water-soluble packet of claim 2, wherein the methyl acrylate comprises about 5 mol % of the copolymer.

5. The water-soluble packet of claim 2, wherein the PVOH and methyl acrylate resin comprises about 35 to about 90 wt. % of the film, based on the total weight of the film.

6. The water-soluble packet of claim 1, wherein the thickness of the water soluble film is in a range of about 3 mil to about 6 mil (about 0.076 mm to about 0.15 mm).

7. The water-soluble packet of claim 1, wherein the PVOH copolymer viscosity is in a range of about 8 cPs to about 40 cPs.

8. The water-soluble packet of claim 1, further comprising about 10 to about 50 parts of plasticizer, per 100 parts PVOH copolymer resin.

9. The water-soluble packet of claim 8, wherein the plasticizer comprises a material selected from the group consisting of sorbitol, glycerol, diglycerol, propylene glycol, ethylene glycol, diethyleneglycol, triethylene glycol, tetraethyleneglycol, polyethylene glycols up to MW 400, 2 methyl 1,3 propane diol, lactic acid, monoacetin, triacetin, triethyl citrate, 1,3-butanediol, trimethylolpropane (TMP), polyether triol, and combinations thereof.

10. The water-soluble packet of claim 1, further comprising less than about 2 parts of surfactant, per 100 parts PVOH copolymer resin.

11. The water-soluble packet of claim 10, wherein the surfactant comprises a material selected from the group consisting of dialkyl sulfosuccinates, lactylated fatty acid esters of glycerol and propylene glycol, lactylic esters of fatty acids, sodium alkyl sulfates, polysorbate 20, polysorbate 60, polysorbate 65, polysorbate 80, alkyl polyethylene glycol ethers, lecithin, acetylated fatty acid esters of glycerol and propylene glycol, sodium lauryl sulfate, acetylated esters of fatty acids, myristyl dimethylamine oxide, trimethyl tallow alkyl ammonium chloride, quaternary ammonium compounds, salts thereof and combinations of any of the forgoing.

12. The water-soluble packet of claim 1, wherein the alkaline sensitive material comprises an enzyme.

13. The water-soluble packet of claim 1, wherein the first sealed compartment and the packet comprising the alkaline sensitive material are optionally conjoined about a partitioning wall.

14. The water-soluble packet of claim 13, wherein the first composition and the alkaline sensitive material are combinations of compositions selected from the group consisting of: liquid, liquid; liquid, powder; and powder, powder.

15. The water-soluble packet of claim 13, wherein the alkaline sensitive material comprises an enzyme.

16. The water-soluble packet of claim 1, wherein the first composition comprises an inorganic bleach.

17. The water-soluble packet of claim 1, wherein the first composition comprises sodium carbonate, percarbonate, or a combination thereof.

18. The water-soluble packet of claim 1, wherein the first composition is coated with a coating material comprising polyethylene glycol.

19. The water-soluble packet of claim 18, wherein the coating has a thickness in a range of about 20 mil to about 150 mil (about 0.5 mm to about 3.8 mm).

20. The water-soluble packet of claim 1, wherein the water-soluble film remains intact for at least 9 minutes when submerged in water heated to a temperature of about 40° C., as determined by Bleach Compatibility Method B, and thereafter fully dissolves within 55 minutes.

21. A method of making a packet for delayed solubility and delayed release of an alkaline component therein in hot water of a selected temperature, comprising:

preparing a packet according to claim 1;

selecting a mol % of the acrylate units in the copolymer, a viscosity of the copolymer, and a thickness of the film to provide a desired delay in solubility of the film in hot water of the selected temperature prior to full dissolution of the film in the hot water of the selected temperature.

22. A water-soluble packet, comprising: a first sealed compartment containing a first composition comprising a mixture of sodium carbonate and percarbonate and being alkaline such that 5.8 g of the composition in 500 ml of 40° C. deionized water yields a pH of 9.5 or higher, the first sealed compartment comprising a water-soluble film comprising a polyvinyl alcohol (PVOH) and methyl acrylate resin consisting of vinyl alcohol units, vinyl acetate units and about 5 mol % methyl acrylate units and having a thickness of about 3 mil to about 6 mil (about 0.076 mm to about 0.15 mm), wherein sufficient pendant carboxyl groups from the acrylate in the copolymer are in the form of lactone rings such that the water-soluble film remains intact for at least 8 minutes when submerged in water heated to a temperature of about 40° C., as determined by Bleach Compatibility Method A, and thereafter the film fully dissolves within 55 minutes, and the packet further comprising a second sealed compartment containing a second composition which is alkaline sensitive, wherein the first sealed compartment and the second sealed compartment are optionally conjoined about a portioning wall, wherein the second composition further comprises a laundry additive.

23. The water-soluble packet of claim 22, wherein the alkaline sensitive material comprises an enzyme.

24. A water-soluble packet comprising a first sealed compartment containing a first composition, the first sealed compartment comprising a wall of water-soluble film, the water-soluble film comprising a copolymer of polyvinyl alcohol (PVOH) and acrylate resin and the first composition comprising an alkaline agent, wherein the alkaline agent is enclosed in a second packet, and the second packet is coated with a hard crystalline sugar coating.

25. The water-soluble packet of claim 24, wherein the hard crystalline sugar coating comprises a mixture of granulated sugar and corn syrup.

26. The water-soluble packet of claim 24, wherein the hard crystalline sugar coating comprises granulated sugar and corn syrup in a weight ratio in a range of about 5:1 to about 1:5.

27. The water-soluble packet of claim 24, wherein the first composition comprises an inorganic bleach.

28. The water-soluble packet of claim 24, wherein the first composition is alkaline such that 5.8 g of the composition in 500 ml of 40° C. deionized water yields a pH of 9.5 or higher.

* * * * *